US006692135B2

(12) United States Patent
Li

(10) Patent No.: US 6,692,135 B2
(45) Date of Patent: Feb. 17, 2004

(54) ATTACHABLE LIGHTING SYSTEM FOR OUTDOOR UMBRELLA

(76) Inventor: Wanda Yiing Li, 1301 St. Tropez Cir., #2104, Weston, FL (US) 33326

( * ) Notice: Subject to any disclaimer, the term of this patent is extended or adjusted under 35 U.S.C. 154(b) by 46 days.

(21) Appl. No.: 10/172,438

(22) Filed: Jun. 17, 2002

(65) Prior Publication Data

US 2003/0230331 A1 Dec. 18, 2003

(51) Int. Cl.[7] ..... A45B 3/02

(52) U.S. Cl. ..... 362/102; 362/234; 362/403; 362/396; 135/16; 135/910

(58) Field of Search ..... 362/102, 234, 362/396, 403; 135/161, 910

(56) References Cited

U.S. PATENT DOCUMENTS 3,801,809 A * 4/1974 Slade ..... 135/910
6,439,249 B1 * 8/2002 Pan et al. ..... 362/102
6,598,990 B2 * 7/2003 Li ..... 362/102

* cited by examiner

*Primary Examiner*—Stephen Husar
(74) *Attorney, Agent, or Firm*—Raymond Y. Chan; David and Raymond Patent Group

(57) ABSTRACT

An attachable lighting system for an outdoor umbrella includes at least an illuminating arrangement which includes at least an illuminating unit for illumination, an illuminating unit supporter which has an guiding surface formed on a bottom portion thereof and is securely connected to the awning frame, an illuminating unit adaptor, and a power supply device. The illuminating unit adaptor has a holding member securely connected to the illuminating unit and an engagement member having an engaging surface arranged to slidably engage with the guiding surface of the illuminating unit supporter, wherein the illuminating unit adaptor is detachably attached to the illuminating unit supporter in such a manner that the illuminating unit connected to the illuminating unit adaptor is capable of sliding to maintain a substantially vertical orientation when the awning frame is folding and unfolding or supported in an inclined position. The power supply device electrically connected to the illuminating unit and supported by the awning frame for transmitting electricity to the illuminating unit.

60 Claims, 13 Drawing Sheets

ATTACHABLE LIGHTING SYSTEM FOR OUTDOOR UMBRELLA

BACKGROUND OF THE PRESENT INVENTION

1. Field of Invention

The present invention relates to an outdoor umbrella, and more particularly to an outdoor umbrella incorporated with an attachable lighting system which can provides illumination and is fully compatible with a folding and unfolding motion of the umbrella.

2. Description of Related Arts

Outdoor umbrella are commonly used in many places, such as beach areas, patio areas, campsites or domestic gardens etc, for shading sunlight in the daytime. A conventional outdoor umbrella usually comprises an umbrella base, a supporting stem upwardly extended therefrom, a foldable awning frame which comprises a plurality of awning supporting arms radically and outwardly extended from an upper end portion of the supporting stem, and an fabric-made awning securely and foldably mounted on the awning supporting arms. None of the conventional outdoor umbrella provides any lighting device to be mounted thereon. As a consequence, during nighttime, a user of the umbrella may either mount a lighting device, such as a portable lamp onto the supporting stem of the umbrella, or simply set up a ground lighting device on the ground in which the umbrella stands for illumination.

It is a challenging task for incorporating a lighting system with an outdoor umbrella because the outdoor umbrella needs to be folded and unfolded frequently. Therefore, the lighting devices have to be installed in such a manner that they are compatible with the folding and unfolding actions of the umbrella and that all such actions would not impart any potential damage to the lighting devices. Electrically, one has to ensure that all lighting devices are properly connected, and that the folding and unfolding movement would not cause any interruption of electricity supplied to the lighting devices. Someone may wind a series of small light bulbs connected by a cord, or some sorts of decorative lighting devices along the awning supporting arms of an outdoor umbrella in order to provide illumination. However, these typical lighting means are generally not suitable for outdoor umbrellas in the sense that they are not flexible enough to match with the folding and unfolding actions, or specifically the relative motion of the awning supporting arms of the outdoor umbrellas. In worse, during folding and unfolding, the movement of the awning supporting arms may destroy the small light bulbs or connecting cord hanged thereon, and this may further cause more serious disaster such as electric shock of the user.

As a matter of fact, because of the above-mentioned considerations, independent lighting devices can only be securely mounted on the awning supporting arms in the positions where they would not be hit by any other awning supporting arms.

Under certain circumstances, the user of the outdoor umbrella may want it to be partly opened or opened and supported inclinedly to shade the sunshine from a specific angle, for example the sunshine from the west during the afternoon. However, when the awning frame is opened and supported Inclinedly, any lighting device manually mounted thereon will be moved to an inclined angle too. As a result, the normal illumination effect of the lighting device is adversely affect, for example the illuminating direction may change from illuminating downwardly on the table and users located right below the awing to illuminating outwardly and sidewardly.

In addition, since an outdoor umbrella is by itself designed to be foldable for easy transportation and other reasons, the lighting device mounted thereon should fully compatible with the umbrella and, therefore, should be constructed in a detachable manner for easy storage and for easy carrying, especially when the umbrella is folded. Under certain circumstances, such as when the user does not want the lighting system to be mounted onto the umbrella for a certain period of time, the user may simply detach the lighting system from the umbrella to store separately.

SUMMARY OF THE PRESENT INVENTION

A main object of the present invention is to provide an outdoor umbrella incorporated with a lighting system to provide illumination while it is fully compatible with the folding and unfolding motions of the umbrella.

Another object of the present invention is to provide an outdoor umbrella incorporated with a lighting system which is capable of self-adjusting the direction of illumination at a predetermined angle regardless the folding and unfolding motion of the umbrella and the inclined angle of the awning.

Another object of the present invention is to provide an outdoor umbrella incorporated with a lighting system which can be easily attached and detached anytime and anywhere by an user.

Another object of the present invention is to provide an outdoor umbrella that incorporates with a lighting system without significantly altering the original structure and appearance of the outdoor umbrella, so as to minimize the manufacturing cost of the present invention.

Thus, in order to achieve the above objects, the present invention provides an outdoor umbrella, comprising:

an umbrella awning;

an umbrella supporting frame which comprises a main supporting stem;

an awning frame which is supported by the main supporting stem and comprises a plurality of awning supporting arms outwardly extended from the umbrella supporting frame to support the awning to define a shading zone thereunder;

an attachable lighting system comprising at least an illuminating arrangement which comprises:

at least an illuminating unit for illumination;

an illuminating unit supporter which has an guiding surface formed on a bottom portion thereof and is securely connected to the awning frame; and an illuminating unit adaptor which has a holding member securely connected to the illuminating unit and an engagement member having an engaging surface arranged to slidably engage with the guiding surface of the illuminating unit supporter, wherein the illuminating unit adaptor is detachably attached to the illuminating unit supporter in such a manner that the illuminating unit connected to the illuminating unit adaptor is capable of sliding to maintain a substantially vertical orientation when the awning frame is folding and unfolding or supported in an inclined position; and a power supply device electrically connected to the illuminating unit and supported by the awning frame for transmitting an electricity to the illuminating unit.

DETAILED DESCRIPTION OF THE PREFERRED EMBODIMENT

Figure 1A:
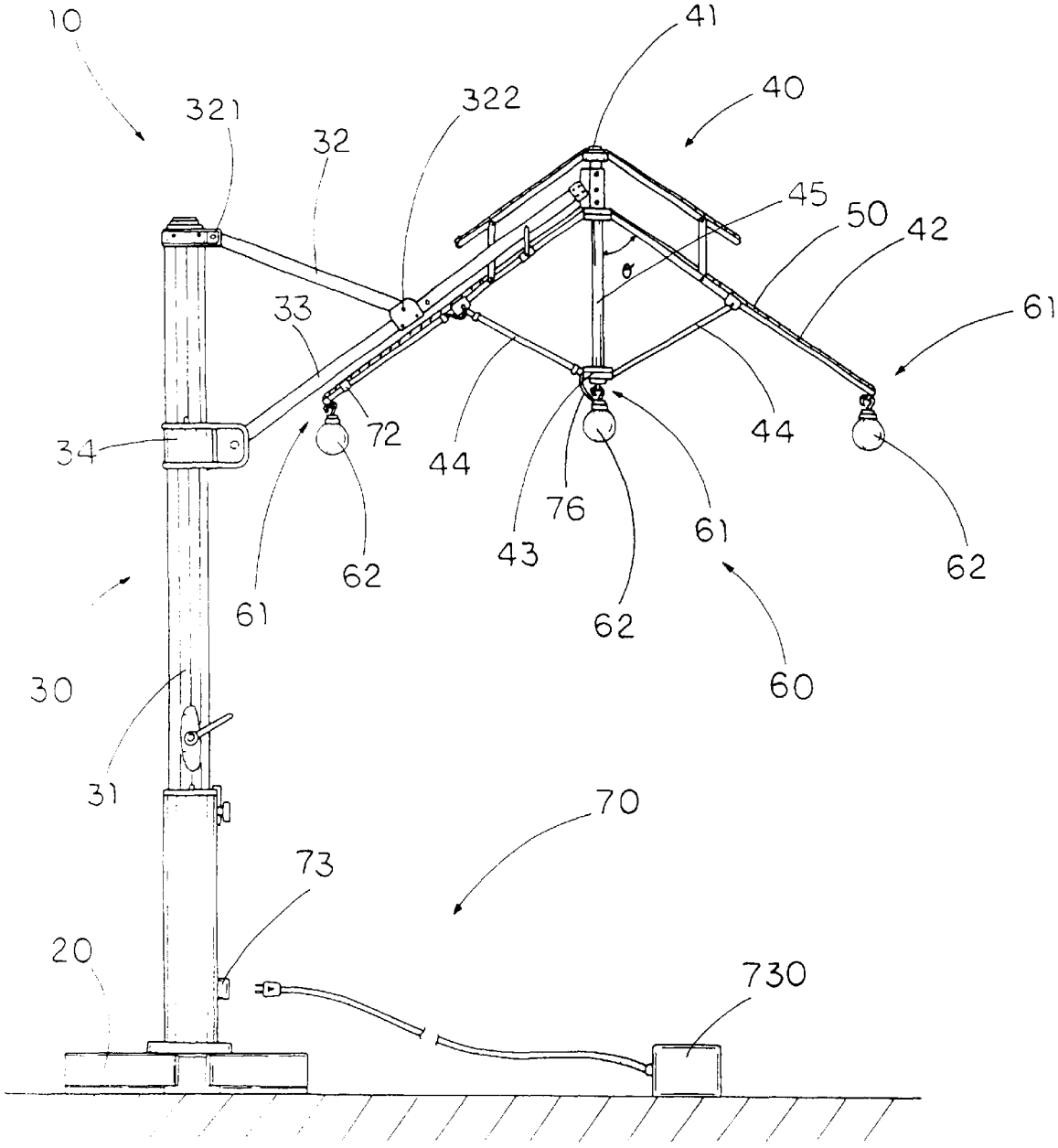
FIG. 1A is an elevation view of an outdoor umbrella incorporated with a lighting system according to a first preferred embodiment of the present invention, illustrating that the umbrella is unfolded.
Figure 1B:
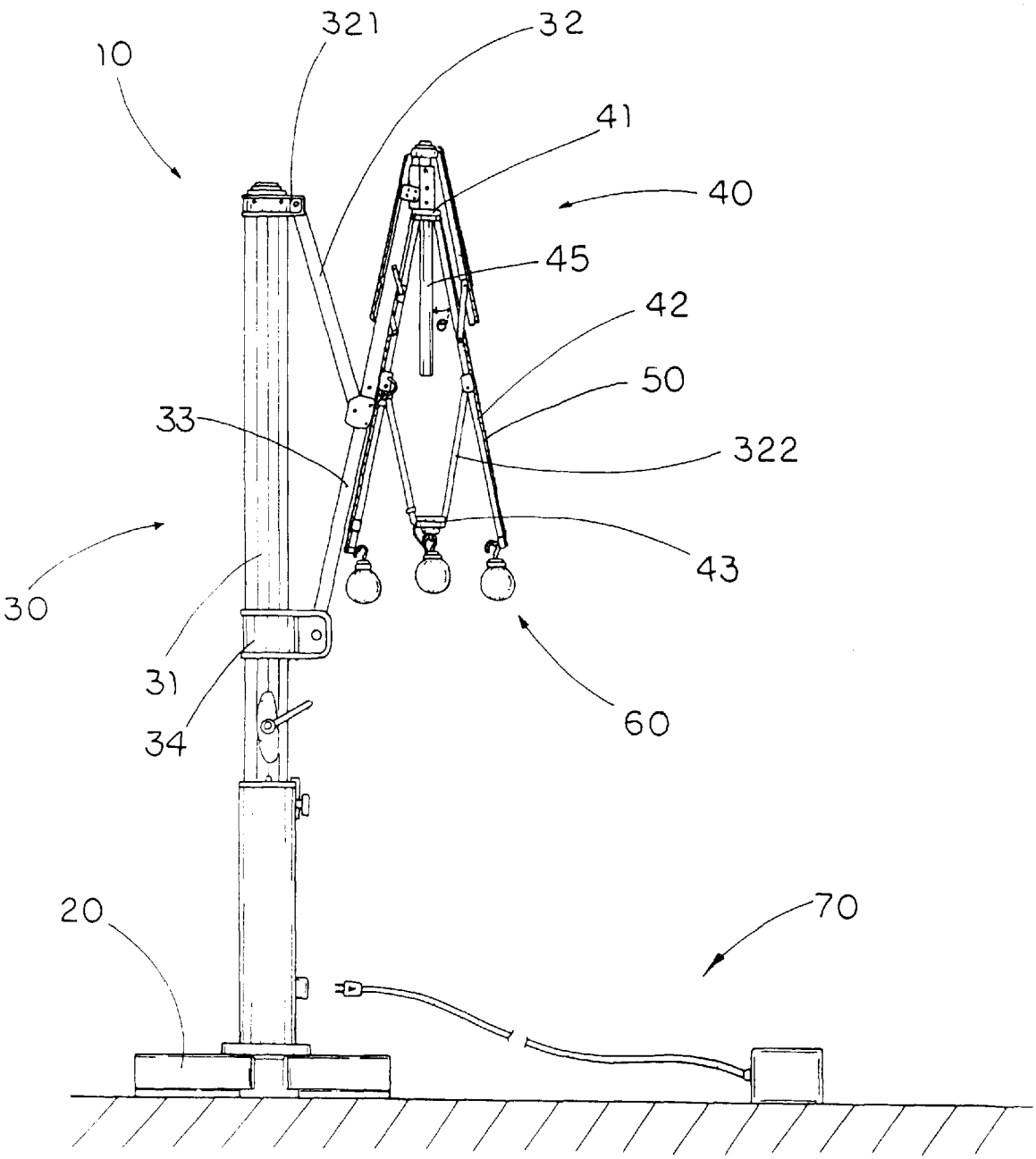
FIG. 1B is an elevation view of an outdoor umbrella incorporated with a lighting system according to the above first preferred embodiment of the present invention, illustrating that the umbrella is folding up.
Figure 1C:
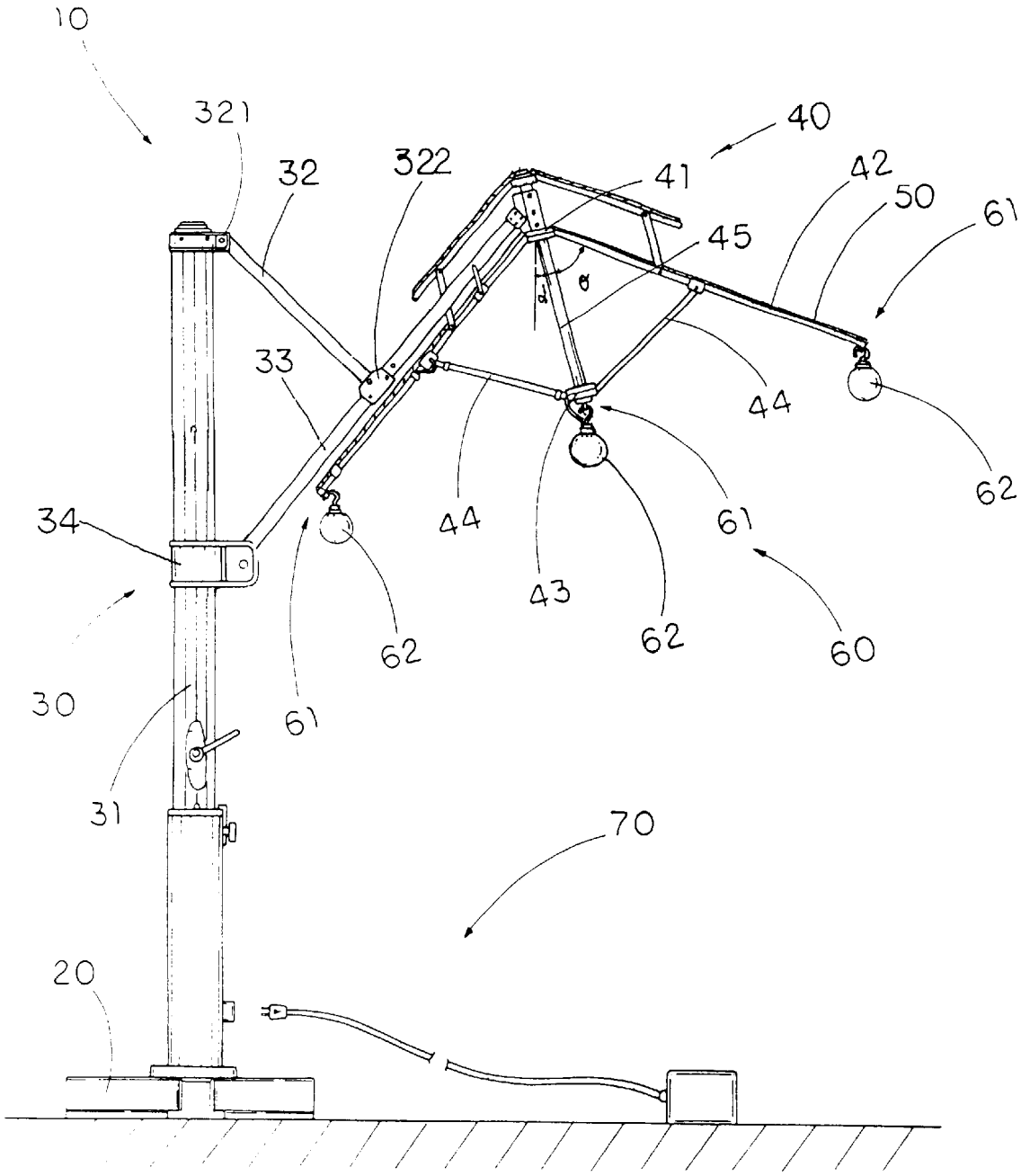
FIG. 1C is an elevation view of an outdoor umbrella incorporated with a lighting system according to the above first preferred embodiment of the present invention, illustrating that the umbrella awning is inclinedly positioned.

Referring to FIGS. 1A to 14 of the drawing, an outdoor umbrella 10 incorporated with lighting, system according to a preferred embodiment of the present invention is illustration. As shown in FIGS. 1A to 1C, the outdoor umbrella 10 comprises an umbrella base 20, an umbrella supporting frame 30 supported by and vertically extended from the umbrella base 20, a foldable awning frame 40 supported by the umbrella supporting frame 30, a fabric-made umbrella awning 50 mounted on the foldable awning frame 40 for shading, a lighting system 60 supported by the foldable awning frame 40 and the umbrella supporting frame 30 for providing illumination, and an power supply device 70 extended from the lighting system 60 to an electricity source so as to transmit electricity to the lighting system 60.

The umbrella supporting frame 30 comprises a main supporting stem 31 vertically and securely affixed on the umbrella base 20, a stem connecting arm 32, an awning frame supporting arm 33, and a control joint 34 slidably mounted on the main supporting stem 31.

The stem connecting arm 32 has a supporting end 321 pivotally connected to an upper portion of the main supporting stem 31 and a connecting end 322 pivotally connected to a middle portion of the awning frame supporting arm 33 in such as manner that the stem connecting arm 32 is able to be sidewardly extended from the main supporting stem 31 so as to securely support the foldable awning frame 40 in a foldable manner.

The foldable awning frame 40 comprises an upper housing 41, a plurality of awning supporting arms 42 spacedly and radially extended from the upper housing 41, an lower housing 43, a plurality of lower connecting bars 44 each having a lower end pivotally connected to the lower housing 43 and an upper end pivotally connected to a mid-position of the respective awning supporting arms 42 so as to support the awning supporting arms 42 in a pivotally movable manner that the awning frame 40 is capable of folding between a folded position by moving the lower housing 43 apart from the upper housing 41 and an unfolded position by moving the lower housing 43 towards the upper housing 41.

The foldable awning frame 40 further comprises a supporter bar 45 downwardly extended from the upper housing 41. Therefore, when the lower housing 43 is connected to a bottom end of the supporter bar 45, the foldable awning frame 40 is supported in the unfolded condition as shown in FIG. 1A, wherein the awning supporting arms 42 are radially extended to define a shading zone thereunder. Otherwise, to fold up the awning frame 40, the lower housing 43 can be disconnected and downwardly move away from the bottom end of the supporter bar 45, as shown in FIG. 1B, wherein the awning supporting arms 42 are overlappedly and inwardly folded to lay in position longitudinally.

The awning frame supporting arm 33 has a bottom end pivotally connected to the control joint 34 and a top end pivotally connected to the upper housing 41, so as to mount the awning frame 40 at one side of the main supporting stem 31. As shown in FIG. 1A, when the control joint 34 is slid up and locked at an upper position of the main supporting stem 31, the awning frame 40 is supported at the unfolded position while the lower housing 43 is moved up to connect with the supporter bar 45. As shown in FIG. 1B, when the control joint 34 is slid down and locked at a lower position of the main supporting stem 31, the awning frame 40 is supported at the folded position while the lower housing 43 is moved down and detached from the supporter bar 45.

The umbrella awning 50 can be made of fabric or plastic material and is mounted on the plurality of awning supporting arms 42 in a foldable manner to cover the awning frame 40 so as to define a shading zone below the awning frame 40 and the umbrella awning 50.

Furthermore, the pivotally connected stem connecting arm 32 allows the umbrella awning 50 supported in different orientation with respect to the ground. As shown in FIG. 1C, when the control joint 34 is slid up and locked at a position between the upper and lower locked positions of the main supporting stem 31 and the awning frame 40 is supported at the unfolded position while the lower housing 43 is moved up to connect with the supporter bar 45, the umbrella awning 50 and the awning frame 40 are unfolded and supported in an inclined position with respect to the vertical main supporting stem 31.

The lighting system 60 comprises at least an illuminating arrangement 61 provided at the lower housing 43 or a lower end of any of the awning supporting arms 42. According to the preferred embodiment as shown in FIGS. 1A to 1C, a plurality of illuminating arrangements 61 are provided at the lower housing 43 and the lower ends of the awning supporting arms 42 respectively.

Each of the illuminating arrangements 61 comprises at least an illuminating unit 62 for generating light and means for attaching the illuminating unit 62 to the lower housing 43 or the respective awning supporting arm 42 in a vertically down hanging manner so as to maintain the light generated by the illuminating unit 62 directing downwards when the awning frame 40 is either in the unfolded position as shown in FIG. 1A, the folded position as shown in FIG. 1B, or the inclined unfolded position as shown in FIG. 1C. According to the preferred embodiment of the present invention, the illuminating unit 62 is a typical light bulb. Please note that the illuminating unit 62 can be other illuminating article such as LED, halogen lamp, fluorescent lamp, and etc.

The attaching means comprises an illuminating adaptor 64 connected to the illuminating unit 62 and an illuminating unit supporter 65 provided at the lower housing 43 or the respective lower end of the awning supporting arm 42, wherein the illuminating unit adaptor 64 is detachably mounted to the illuminating unit supporter 65 in a suspending manner. Moreover, the illuminating arrangement 61 further comprises a locking means for locking the illuminating unit 62 at any position with respect to the awning frame 40.

Figure 2:
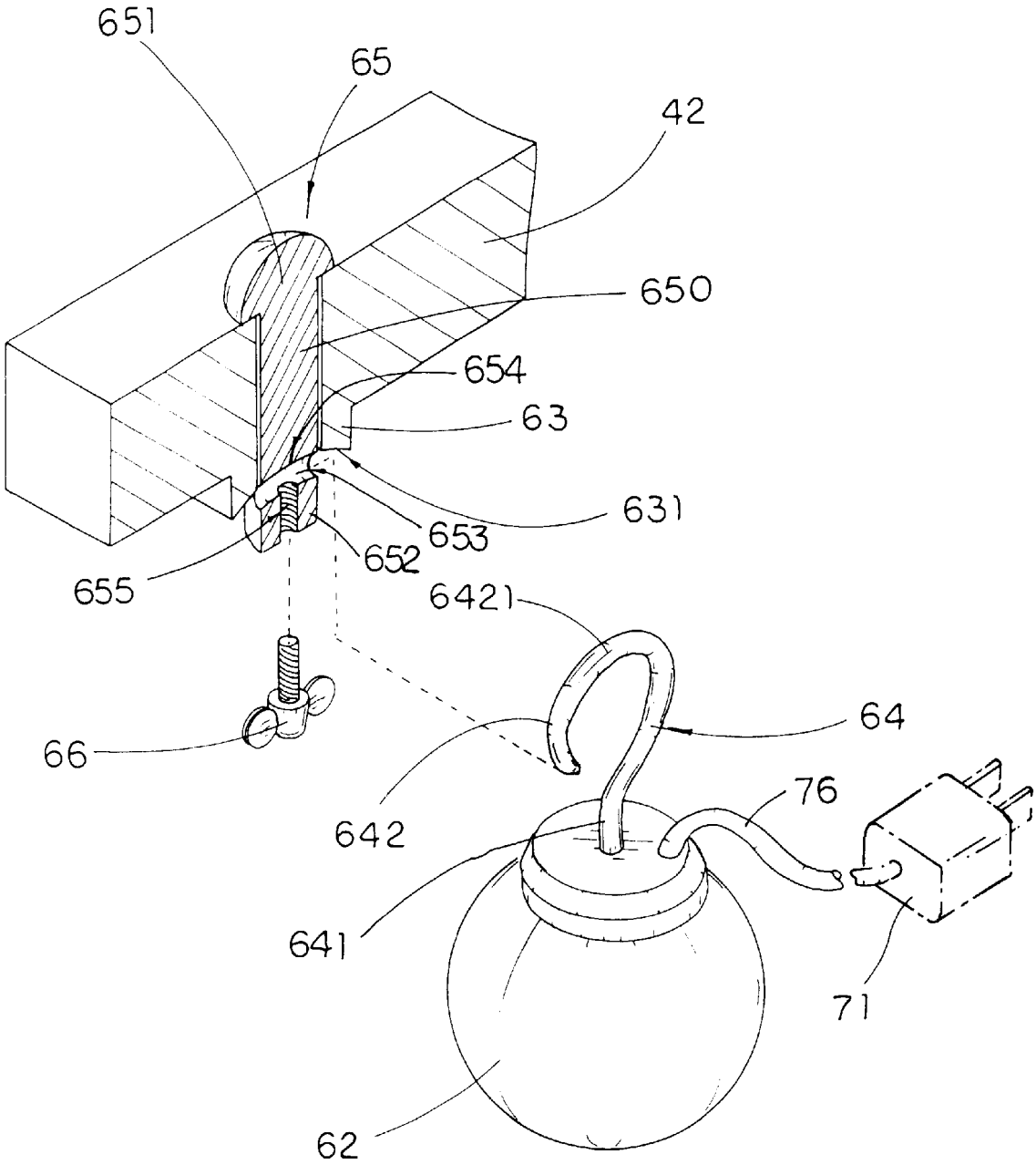
FIG. 2 is a partially sectional exploded perspective view of the illuminating arrangement according to the above preferred embodiment of the present invention, illustrating how the illuminating unit is mounted to the awning supporting arm.
Figure 3A:
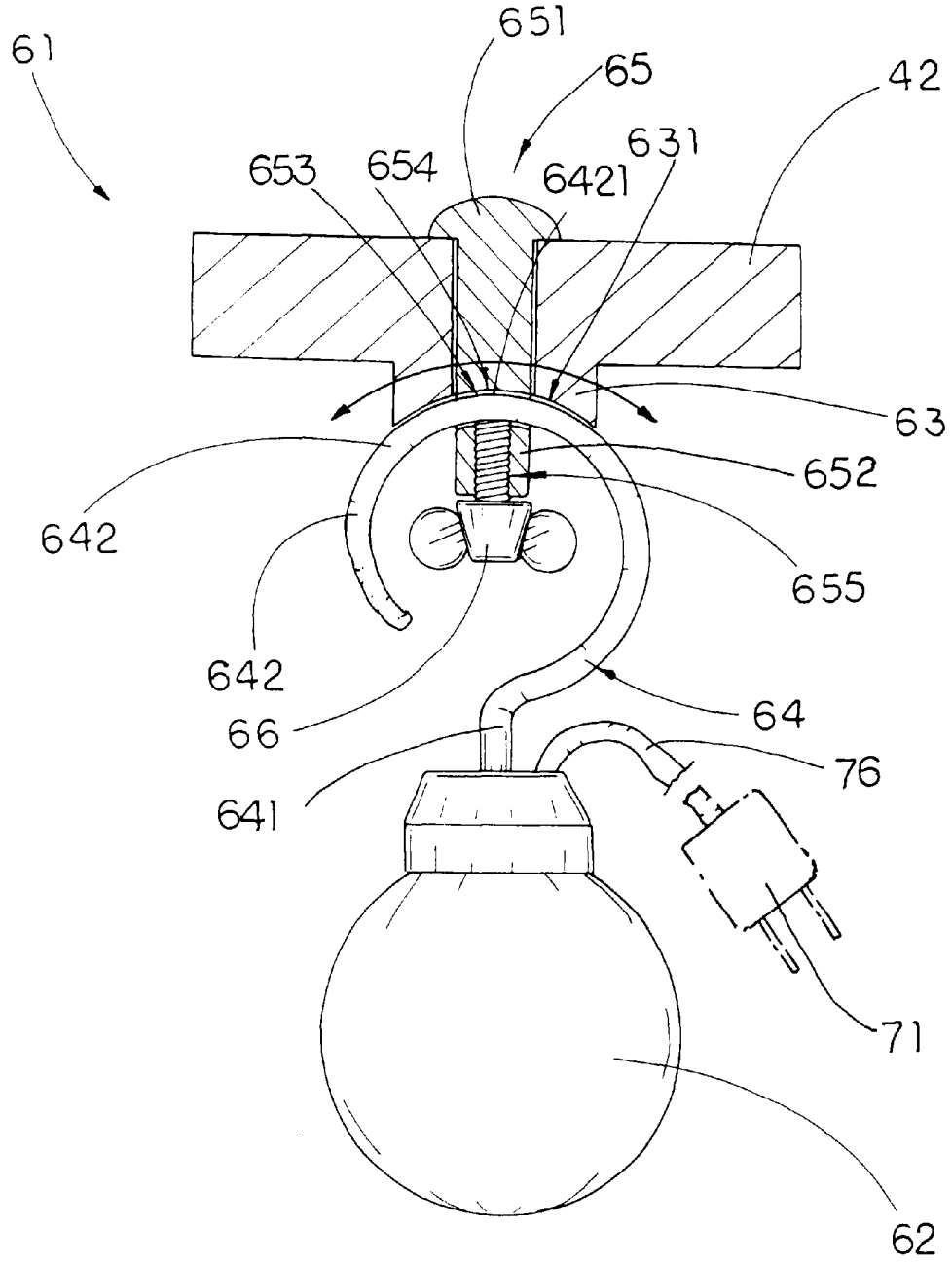
FIG. 3A is a partially sectional view of the illuminating arrangement according to the above preferred embodiment of the present invention, illustrating how the illuminating unit is mounted to the awning supporting arm.
Figure 3B:
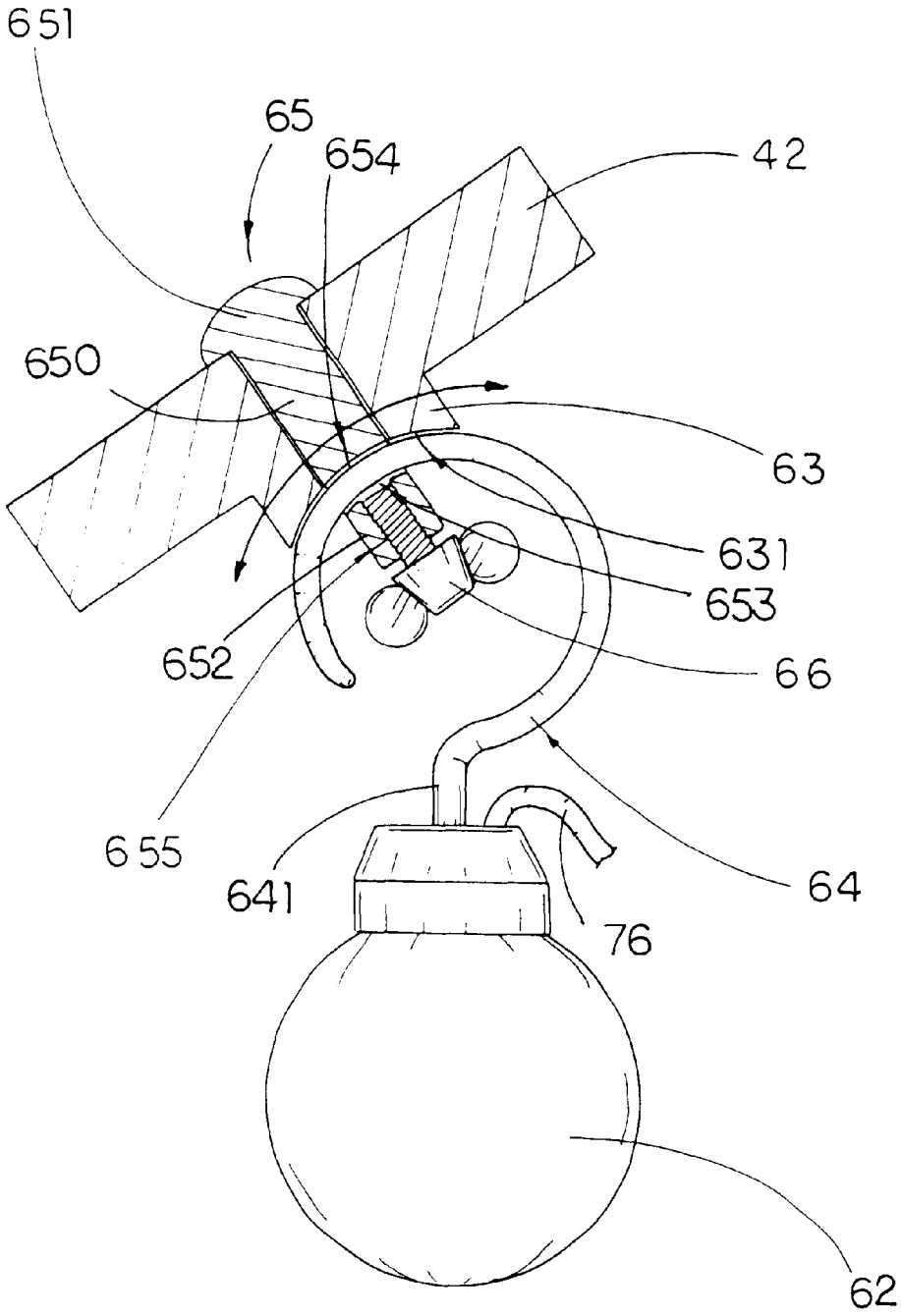
FIG. 3B is a partially sectional view of the illuminating arrangement according to the above preferred embodiment of the present invention, illustrating how the illuminating unit maintains its substantially vertical orientation while the awning supporting arm is extended in an inclined position.

Referring to FIGS. 2 to 3B of the drawings, the illuminating arrangement 60 is embodied to be detachably mounted at the lower end of the respective awning supporting arm 42. According to the preferred embodiment, the illuminating unit supporter 65 is embodied as (but not limited to) a shank body 650 transversely extended therethrough, which has an enlarged head 651 mounted on an outer side of the lower end of the respective awning supporting arm 42 and a connecting member 652 protruded from an inner side of the lower end of the awning supporting arm 42, wherein a mounting slot 653 is transversely penetrating through the connecting member 652.

The illuminating unit adaptor 64 has a holding member 641 securely connected to the illuminating unit 62 and an engagement member 642. Referring to FIGS. 2 to 4 of the drawings, the engagement member 642 of the illuminating unit adaptor 64 is embodied as a circular shaped hook-like hanging arm extended from the holding member 641 which is connected and upwardly extended from a top end of the illuminating unit 62. The mounting slot 653 has a size slightly larger than a diameter of the engagement member 642, so that the illuminating unit adaptor 64 can be freely hooked on the illuminating unit supporter 65 by hooking the engagement member 642 through the mounting slot 653, as shown in FIGS. 2 and 4. Although the awning supporting arm 42 is extended at a slant position during the unfolded position as shown in FIGS. 1A and 1C, the weight of the illuminating unit 62 renders the illuminating unit 62 to remain hanging down vertically with respect to the inclined awning supporting arm 42 due to gravity, as shown in FIG. 4, In order to ensure the illuminating unit 62 is mounted in a stable condition by means of the illuminating unit supporter 65, the mounting slot 653 is an arcuate though hole having an arcuate upper surface and an arcuate lower surface, wherein the arcuate upper surface of the mounting slot 653 forms a concave guiding surface 654, wherein the guiding surface 654 is inwardly curved and adapted to direct the illuminating unit 62 to move in a pivotal manner according to the surface curvature of the guiding surface 654, as shown in FIGS. 3A and 3B. Correspondingly, the engagement member 642 has a convex engaging surface 6421 formed thereon, wherein the engaging surface 6421 is shaped and sized to have a surface curvature matched with the surface curvature of guiding surface 654 of the illuminating unit supporter 65.

Accordingly, the guiding surface 654 is in full contact with the engaging surface 6421 to maximize the supporting surface area for the engagement member 642 with respect to the illuminating unit supporter 65. When the awning supporting arm 42 varies its inclined angle during folding, unfolding and inclining the awning frame 40, the illuminating unit support 65 will change its position to engage with different portion of the engagement member 642, i.e. the hook-like hanging arm while the illuminating unit 62 will remain hanging down due to gravity.

In order to enhance the supporting ability of the illuminating unit supporter 65 with respect to the engagement member 642 of the illuminating unit adaptor 64 of the illuminating unit 62, to increase the supporting surface area is an effective method. Therefore, a holding head 65 is downwardly protruded from a bottom side of the lower end of the awning supporting arm 42 to provide a concave supporting surface 651 outwardly extended from two ends of the mounting slot 653, wherein the curvature of the supporting surface 631 equals to that of the guiding surface 654, so that the supporting contact area with respect to the engaging surface 6421 of the engagement member 642 can thus be enlarged so as to enhance and reinforce the stability and rigidity of the illuminating arrangement 61.

Moreover, the illuminating unit 62 can also be mounted at any angle and position with respect to the awning frame 40 by means of the locking means. According to the preferred embodiment as shown in FIGS. 2 to 3B, the locking means comprises a connector 66 which is a bolt screwed into an axial threaded connecting hole 655, which is penetrated from a bottom end of the illuminating unit supporter 65 and upwardly extended to the mounting slot 653, until a top biasing end of the connector 66 is pressed against the lower surface of the engagement member 642 so as to press the engaging surface 6421 against the guiding surface 654 and the supporting surface 631 to provide friction therebetween and thus fasten the engagement member 642 in position. Similarly, by unfasten the connector 66 until its biasing end is not contact with the engagement member 642, the engagement member 642 is free to pivotally slide along the mounting slot 653 to adjust the hanging position of the illuminating unit 62. When the user wants to affix a specific hanging position and angle of the illuminating unit 62 with respect to the awning supporting arm 42 and the awning frame 40, the user may simply screw in and tighten the connector 66 into the connecting hole 655 to lock and maintain the illuminating unit 62 in desired position.

In other words, the illuminating unit adaptor 64 is slidably mounted to the illuminating unit supporter 65 so that the engaging surface 6421 is capable of sliding along the guiding surface 654 and supporting surface 631 in such a manner that the locus of its sliding motion substantially follows the geometry of the guiding surface 654 and the supporting surface 631. Therefore, the illuminating unit adaptor 64 and the illuminating unit 62 connected thereon are, by the virtue of the above-mentioned structural connections, capable of moving in accordance with the surface curvature of the guiding surface 654 and the supporting surface 631. However, it is worth to emphasize that the engaging surface 6421 of the illuminating unit adaptor 64 can be of any shape as long as the engaging surface 6421 is capable of sliding along the guiding surface 631 of the illuminating unit supporter 63.

In order to attach the illuminating arrangement 60 to the respective awning supporting arm 42, the user has first to insert the engagement member 642 of the illuminating unit adaptor 64 into the mounting slot 653 of the illuminating unit supporter 65. Afterwards, screw the connector 66 into the connecting hole 655 to bias against and lock the engagement member 642 in position. Note that, when the connector 66 is screwed to just slightly in contact with the engagement member 642, instead of strongly pressing against, the illuminator unit adaptor 64 is capable of sliding pivotally in accordance with the surface curvature of the guiding surface 654 of the illuminating unit supporter 65.

Accordingly, when the awning frame 40 is folding or unfolding, the illuminating units 62 attached to the lower end of the awning supporting arms 42 respectively will each slide to hang at a substantially vertical orientation with respect to the ground due to gravity. In other words, the user of the outdoor umbrella 10 is able to freely adjust the folding or unfolding extent of the awning frame .40 without fearing any deterioration of the illuminating effect and direction of the illuminating units 62.

Figure 4A:
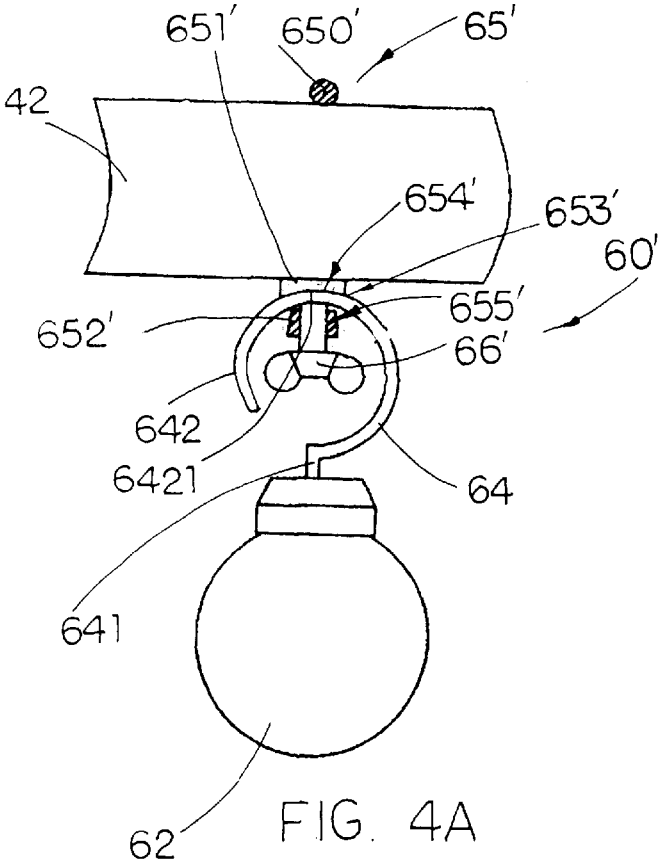
FIG. 4A is a partially sectional view of an alternative mode of the illuminating arrangement according to the above preferred embodiment of the present invention, illustrating how the illuminating unit hanged to the awning supporting arm.
Figure 4B:
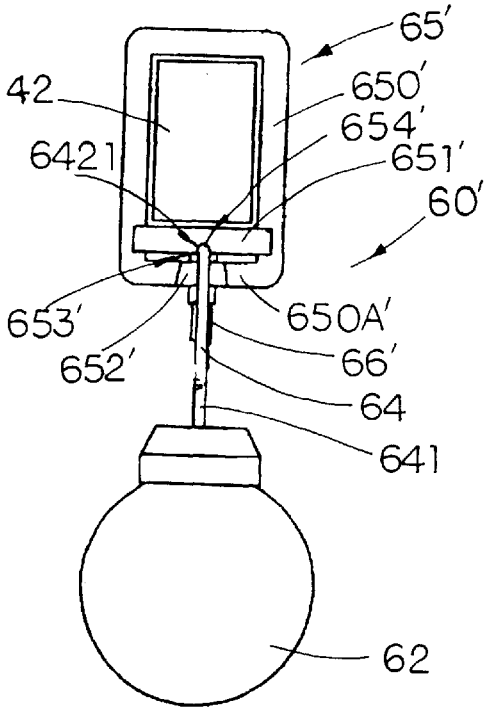
FIG. 4B is an end view of the FIG. 4A illustrating the alternative mode of the illuminating arrangement according to the above preferred embodiment of the present invention.

FIGS. 4A and 4B illustrates an alternative mode of the illuminating unit. supporter 65' of the illuminating arrangement 60' which is adapted for mounting to any existing outdoor umbrella, so that the user may equip one or more illuminating arrangements 60' to his or her outdoor umbrella, wherein the illuminating unit supporter 65' is embodied to comprises a supporting holder 650' slidably mounted on a predetermined position, such as the lower end, of the respective awning supporting arm 42, which has a connecting member 652' provided at a bottom bar 650A' of the supporting holder 650' through which a threaded connecting hole 655' is formed, and a mounting member 651' which forms an arcuate guiding surface 654' at a bottom side thereof, wherein the mounting member 651' is positioned between a bottom side of the awning supporting arm 42 and the bottom bar 650A' of the supporting holder 650' so as to define a mounting slot 653' transversally extended between the guiding surface 654' of the mounting member 651' and the connecting member 652'.

Similarly, the illuminating arrangement 60' is also embodied to comprise the illuminating unit adaptor 64 connected to the illuminating unit 62 as shown in FIGS. 2 to 3B. In which, the engagement member 642 is arranged to be inserted through the mounting slot 653 so as to hang down from the illuminating unit supporter 65'. Therefore, the weight of the illuminating unit 62 will maintain itself to vertically hang down from illuminating unit supporter 65' due to gravity and regardless of the inclined angle of the awning supporting arm 42, as shown in FIGS. 4A and 4B.

Also, the illuminating unit 62 can be mounted at any desired angle and position with respect to the awning supporting arm 42 by means of a locking means which comprises a connector 66' which is a bolt screwed into an connecting hole 655' until a top biasing end thereof is pressed against the lower surface of the engagement member 642 so as to press the engaging surface 6421 of the engagement member 642 against the guiding surface 654' to provide a friction therebetween and thus fasten the engagement member 642 in position.

Referring to FIGS. 1 to 5B of the drawings, when the awning frame 40 is in the folded position, the awning supporting arms 42 are overlappedly folded together, as shown in FIG. 1B. Whereas when the awning frame 40 is in the unfolded position, the awning supporting arms 42 are radially and outwardly extended, as shown in FIG. 1A, such that each of the awning supporting arms 42 defines a predetermined folding angle $\theta$ with a central vertical axis of the awning frame 40, as shown in FIG. 1A. In other words, when the awning frame 40 is being folded or unfolded, the awning supporting arms 42 are folding down or up and the folding angle $\theta$ varies respectively. Therefore, when the awning frame is folded down, as shown in FIG. 1B, a smaller folding angle $\theta'$ is defined between each awning supporting arm 42 and the central vertical axis of the awning frame 40.

Accordingly, from the position of fully unfolded to the position of fully folded, or vice versa, each of the awning supporting arms 42 can at most be pivotally moved by the angle $\theta-\theta'=\alpha$ with respect to the upper housing 41. Thus, the acurate guiding surface 654, 654' and supporting surface 631 of the illuminating unit supporter 63, 63' should have a predetermined total length that allows the illuminating unit adaptor 64 to slide pivotally in a total range of at least the angle $\alpha$. Note that the length of the guiding surface 654, 654' can also be the maximum pivotal displacement of the awning supporting arm 42 to which the illuminating unit supporter 63, 63' is mounted, which is the pivotal displacement of an end of that awning supporting arm 42.

Moreover, it is worth to mention that in order to broaden the utility function of the lighting system 60, the length of the guiding surface 654, 654' of the can be made longer so as to suit the users who, in some occasions, need to inclinedly open the umbrella 10. In these cases, the length of the guiding surface 654, 654' may be extended such that the range of pivotal sliding of the illuminating unit adaptor 64 is $\theta+\alpha$, where $\alpha$ is the angle of inclination, as shown in FIG. 1C.

Figure 8:
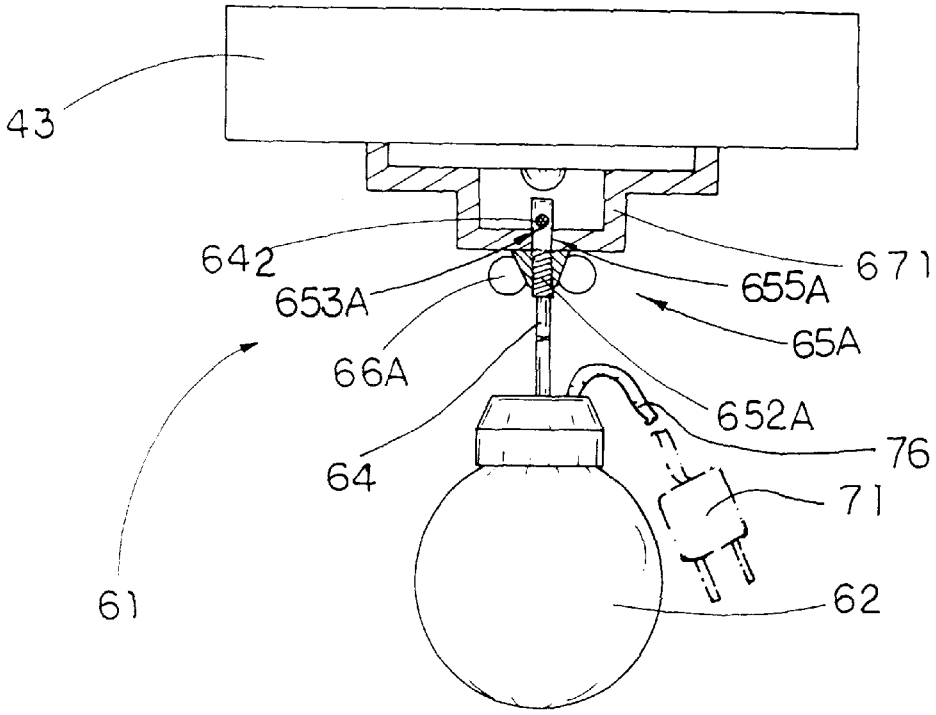
FIG. 8 is a sectional view of the illuminating arrangement according to the above preferred embodiment of the present invention, illustrating how the illuminating unit is mounted to the lower housing of the umbrella awning frame.
Figure 9:
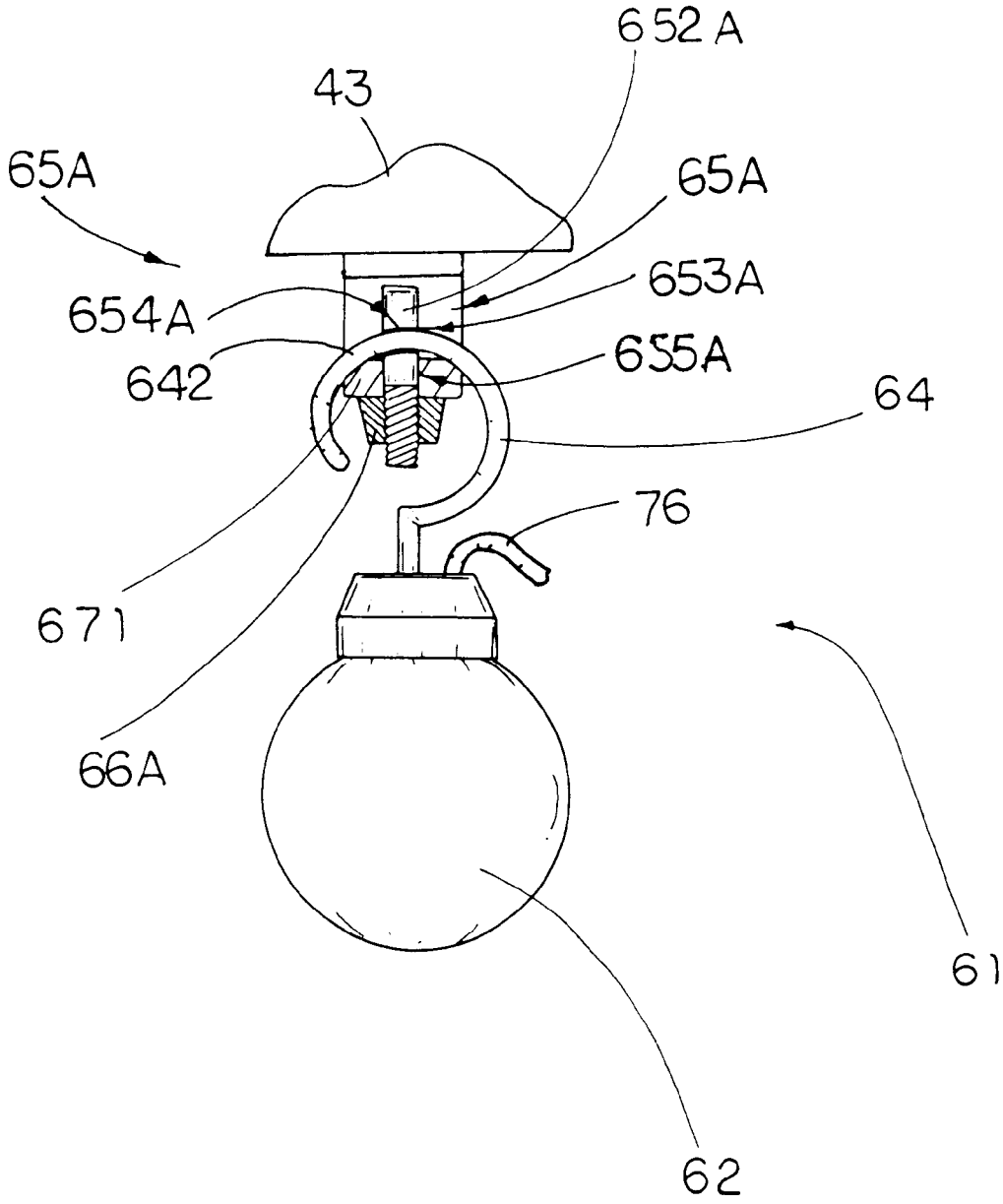
FIG. 9 is a partially sectional side view of the illuminating arrangement mounted to the lower housing according to the above preferred embodiment of the present invention.

Referring to FIG. 8 and 9 of the drawings, the illuminating unit 62 of the illuminating arrangement 61 is embodied to be mounted to the lower housing 43, wherein the illuminating unit supporter 65A comprises a coupling device 67 for mounting the illuminating unit 62 to the lower housing 43. The coupling device 67 comprises a circular coupling base 671 affixed to a bottom side of the lower housing 43, a connector 66A, and a connecting member 652A which has a mounting slot 653A transversally provided at an upper portion and a threaded lower portion, wherein the mounting slot 653A is an arcuate through hole, as shown in FIG. 9, and the upper portion of the connecting member 652A upwardly penetrates through a connecting hole 655A provided at a bottom wall of the coupling base 671 until the mounting slot 653A is positioned inside the coupling base 671. The connector 66A is adapted to screw to the threaded lower portion of the connecting member 652A.

As shown in FIG. 9, the upper surface of the mounting slot 653A also forms an arcuate guiding surface 654A which is inwardly curved and adapted to direct the illuminating unit 62 to move in a pivot manner. Similarly, the surface curvature of the guiding surface 654A is arranged to match with the shape and size of the engaging surface of the engagement member 642. Therefore, the guiding surface 654A is in full contact with the engaging surface of the engagement member 642 to maximize the supporting surface area for the engagement member 642 with respect to the illuminating unit supporter 65A. When the awning frame 40 is inclinedly positioned and the connector 66A is loosely screwed to the connecting member 652A, the illuminating unit support 65A will change its position to engage with the different portion of the engagement member 642, i.e. the hook-like hanging arm, while the illuminating unit 62 remains hanging down due to gravity.

In order to mount the illuminating unit 62 on the coupling device 67 at a desired angle and position, the user can simply tighten the connector 66A with the illuminating unit supporter 65A by screwing the connector 66A towards the coupling device 67. The screwing in of the connector 66A will pull the connecting member 652A down at the same time that will press the engagement member 742 against the bottom wall of the connecting member 652A, as shown in FIG. 9, so as to lock up the relative position of the illuminating unit 62.

Referring to FIGS. 5 to 7B, alternatively, in order to detachably mount the coupling device 67 to the lower housing 43, the coupling device 67 further comprises a clamping means for detachably mounting the coupling base 671 to the lower housing 43, wherein the clamping means comprises a plurality of resilient clamping members 672 each having a coupling portion coupled with the coupling base 671 and one clamping portion upwardly extended therefrom to define a clamping cavity 670 between the clamping portions of the clamping members 672.

Figure 7B:
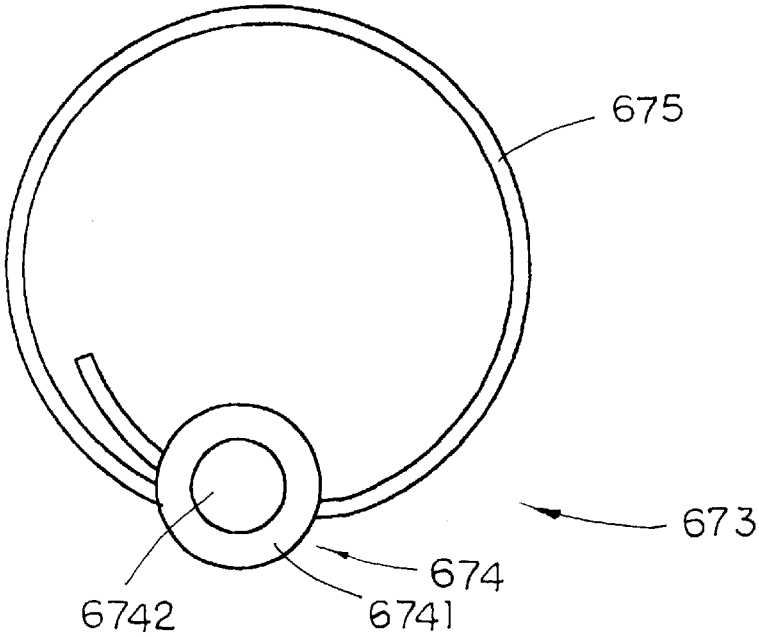
FIG. 7B is a plan view of the fastening device of the FIG. 7A according to the above preferred embodiment of the present invention.
Figure 5:
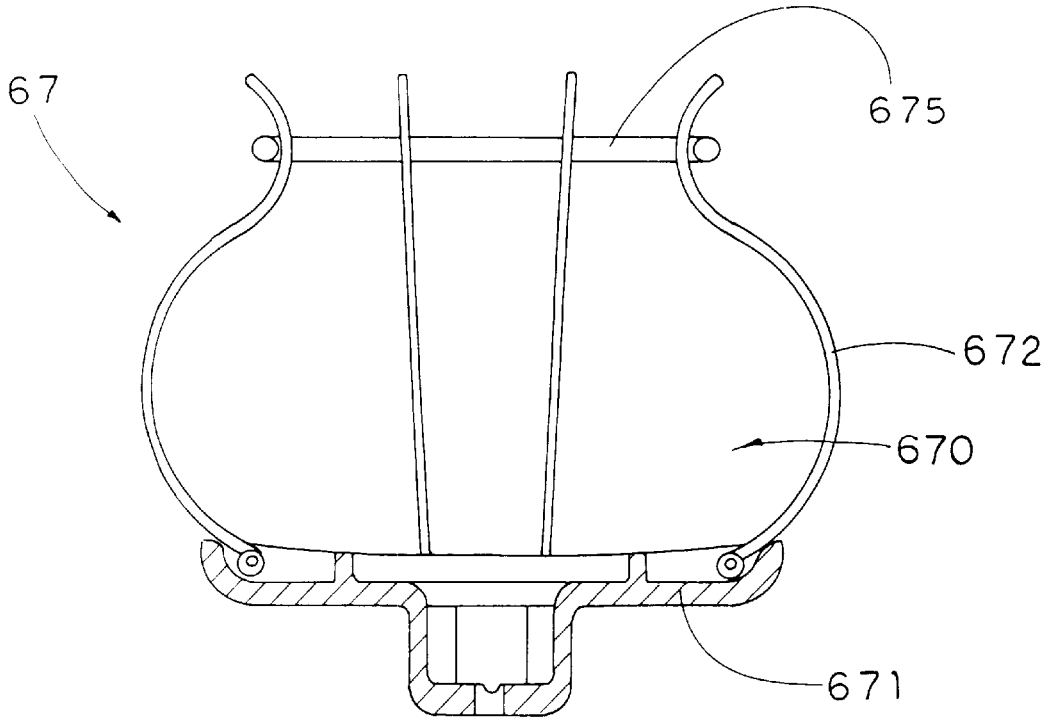
FIG. 5 is a partially sectional side view a coupling device according to the above preferred embodiment of the present invention.
Figure 6:
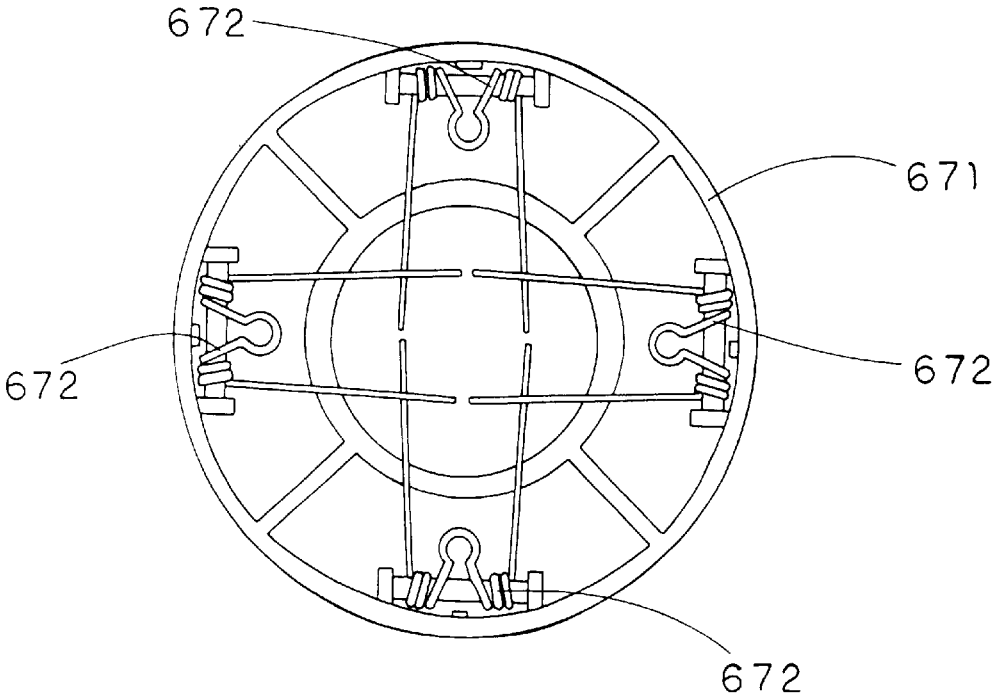
FIG. 6 is a plan view of the coupling device as shown in FIG. 5 according to the above preferred embodiment of the present invention.
Figure 7A:
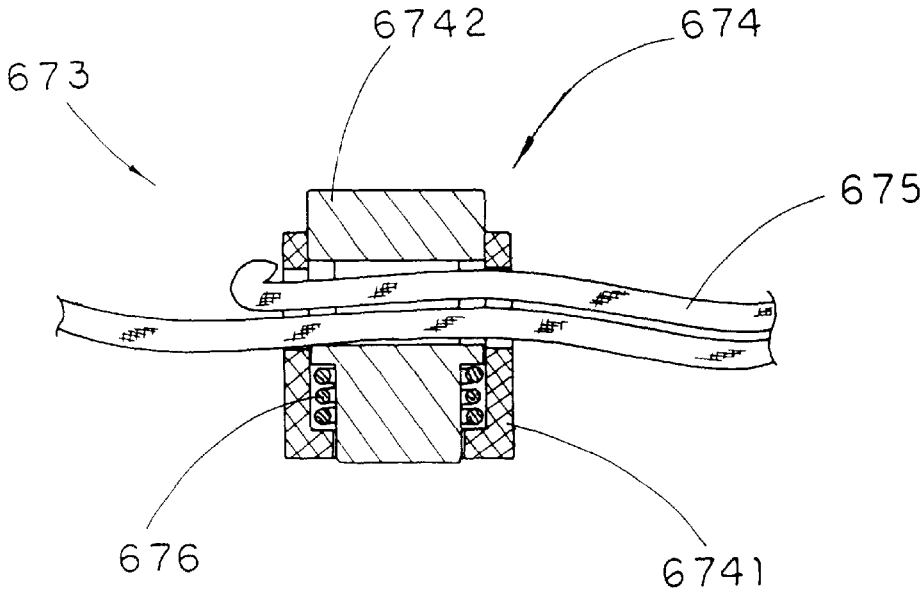
FIG. 7A is a sectional view of a fastening device of the coupling device according to the above preferred embodiment of the present invention.

As shown in FIGS. 7A and 7B, the coupling device 67 further comprises a fastening device 673 for fastening the clamping portions of the clamping members 672 to the lower housing 43. The fastening device 673 comprises a control button 674 and a fastening strap 675. The control button 674 comprises a receiving body 6741 and a presser 6742 slidably inserted thereto, wherein the receiving body 6741 has a through hole formed and the fastening strap 675 is arranged to slidably insert into the through hole of the receiving body 6741. The control button 674 further comprises a resilient element 676 which is received in the receiving body 6741 and arranged to normally apply an urging force to the fastening strap 675 in such a manner that when the presser 6742 is depressed, the fastening strap 675 is capable of freely sliding, and when the depressing force is relieved, the presser 6742 is rebounded to its original position and the fastening strap 675 is pressed by the resilient element 676. Hence, the sliding motion of the fastening strap 675 will be restricted.

On the other hand, the coupling device 67 can be mounted to the lower housing 43 by inserting a bottom portion of the lower housing 43 in to the clamping cavity 670 of the coupling device 67, wherein the fastening strap 675 is tightened around the clamping members 672 by operating the control button 674, as shown in FIGS. 5 to 7B. It is worth mentioning that the user can adjust the tightness of the fastening strap 675 by pressing the control button 674 and freely sliding the fastening strap 75 to obtain a suitable length of the fastening strap 675 so as to securely fasten the coupling device 67 onto the lower housing 43.

Figure 10:
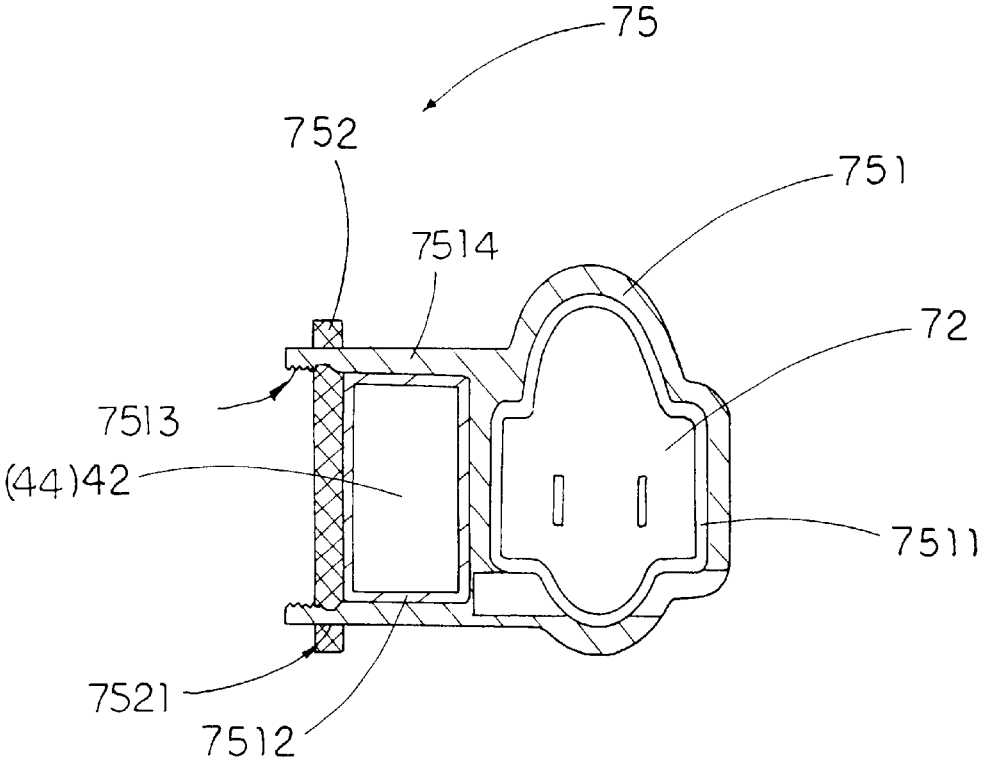
FIG. 10 is a sectional side view of a, socket holder according to the above preferred embodiment of the present invention, illustrating how the connecting socket is securely mounted to the foldable awning frame.

Referring to FIGS. 1A–2, 8 and 10–11 of the drawings, the power supply device 70 comprises at least one connecting plug 71 extended from one of the illuminating units 62, at least a connecting socket 72, as shown in FIG. 10, which is securely mounted on the awning frame 40, such as one of the awning supporting arms 42 or the lower connecting bars 44, and adapted to be plugged by the connecting plug 71, and a power inlet 73, as shown in FIG. 1A, which is extended from the connecting socket 72 along the awning supporting arm 42 and the main supporting stem 31, and adapted for plugging into an external power source 730 so as to transmit electricity to the illuminating units 62. The connection between the illuminating unit 62 and the connecting plug 71, and the connection between the connecting socket 72 and the power plug 73 are both accomplished by typical electrical cords 76.

Figure 11:
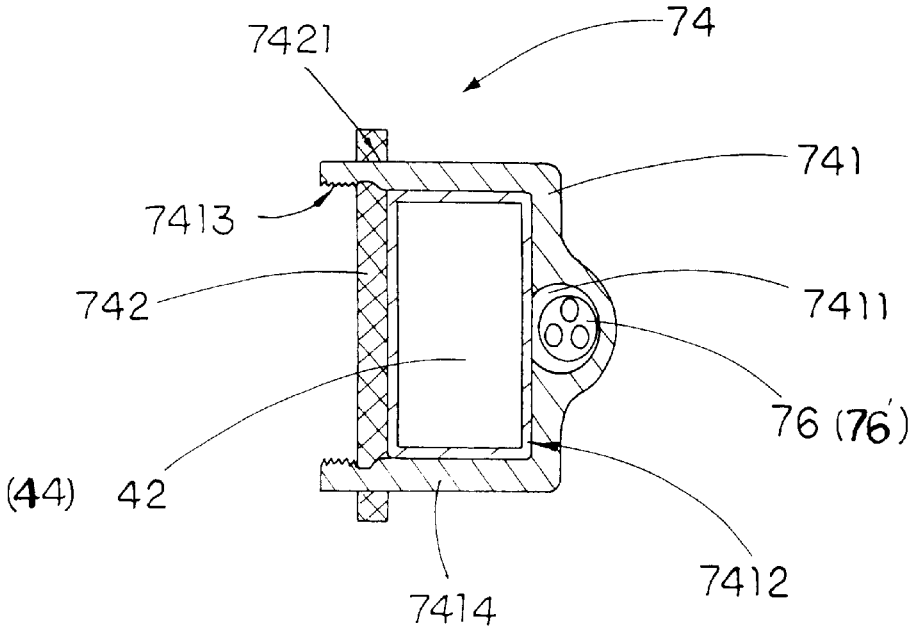
FIG. 11 is a sectional view of a cord holder according to the above preferred embodiment of the present invention, illustrating how an electrical cord is securely mounted along the awning supporting arm.

Moreover, as shown in FIGS. 10 and 11, the power supply device 70 further comprises a cord holder 74 and a socket holder 75 for securely mounting the electrical cords 76 and the connecting socket 72 along the awning supporting arms 42 and the lower connecting bars 44 of the awning frame 40.

The cord holder 74, as shown in FIG. 11, comprises a ring-shaped holding body 741 defining a cord-receiving cavity 7411 for receiving the electrical cord 76 therethrough and a frame-holding cavity 7412, which is communicated with the cord-receiving cavity 7411, for receiving one of the awning supporting arms 42 or the lower connecting bars 44 therethrough. The cord holder 74 further comprises a securing member 742 adapted to engage with the holding body 741 for tightening up the cord holder 74 and securely mounting the cord holder 74 to the respective awning supporting arm 42 or the lower connecting bar 44.

The securing member 742 has two securing slots 7421 at two ends respectively. A plurality of ratchet teeth 7413 are formed on two inner side of two parallel holding arms 7414 of the holding body 741 for engaging through the two securing slots 7421 of the securing member 742 respectively so as to tightening up the cord holder 74. Thus the electrical cord 76 can be securely mounted onto the awning supporting arm 42 by putting the electrical cord 76 into the cord-receiving cavity 7411, then putting the awning supporting arm 42 into the frame-holding cavity 7412, and finally engaging the securing member 742 with the plurality of ratchet teeth 7413 on the holding body 741.

The socket holder 75 comprises a socket holder body 751 defining a socket-receiving cavity 7511 for receiving the connecting socket 72 and a frame-receiving cavity 7512 for receiving the awning supporting arm 42 or the lower connecting bar 44. The socket holder 75 further comprises a tightening member 752 adapted to engage with the socket holder body 751 for tightening up the socket holder 75.

The tightening member 752 has two tightening slots 7521 at two ends thereof respectively. A plurality of ratchet teeth 753 are formed at two inner sides of two parallel holder arms 754 for engaging through the two tightening slots 7521 of the tightening member 752 respectively so as to tightening up the socket holder 75. Thus the connecting socket 72 can be securely mounted onto the awning supporting arm 42 or the lower connecting bar 44 by securing the connecting socket 72 in the socket-receiving cavity 7511, then inserting the awning supporting arm 42 or the lower connecting bar 44 through the frame-receiving cavity 7512, and finally engaging the tightening member 752 with socket holder body 751.

Figure 13:
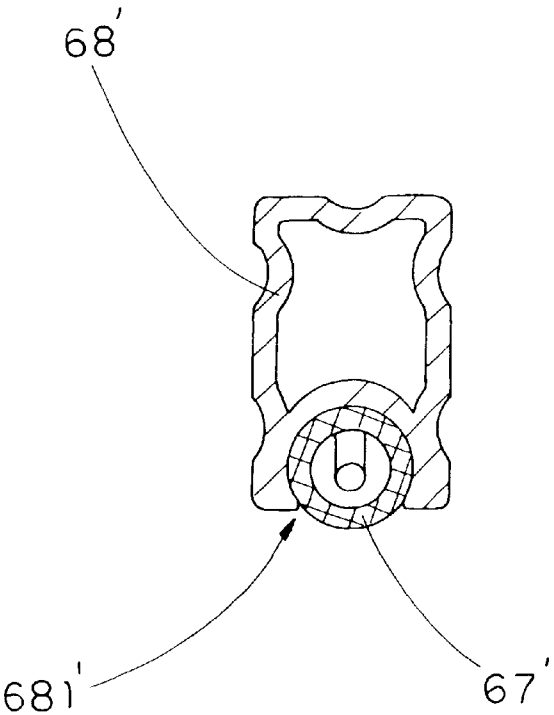
FIG. 13 is sectional view of the alternative illuminating unit of the outdoor umbrella according to the above preferred embodiment of the present invention, illustrating how the alternative illuminating unit mounted to the awning supporting arm.

As shown in FIG. 13, the electrical cord 76 can be replaced with a LED light rope 76' which can also be considered as an alternative illuminating unit. In other words, the cord holder 74 is used to mount the LED light rope 76' along the awning supporting arms 42 and/or the lower connecting bars 44.

It is important to point out that, in order to light up all the illuminating units 62, they must be electrically connected to one or more connecting plugs 71, so long as an equal number of the connecting sockets 72 are provided and that all the connecting sockets 72 are electrically connected to the external power source 730. Or, as an alternative, all the connecting plugs 72 (if more than one) may be electrically connected to one electric hub which is mounted on the awning frame 40 and then electrically connected to an external power source 730.

As an alternative mode of mounting the illuminating arrangement 61 onto the awning frame 40, it is important to stress that the illuminating unit supporter 65 can also be made to be hook-like in shape having a curved guiding surface 651 at its bottom portion, while the illuminating unit adaptor 64 can be of any shape having the curved engaging surface 6421 thereon. In other words, the shapes of the illuminating unit supporter 65 and the illuminating unit adaptor 64 as disclosed in the first preferred embodiment above may be interchangeable.

Figure 12:
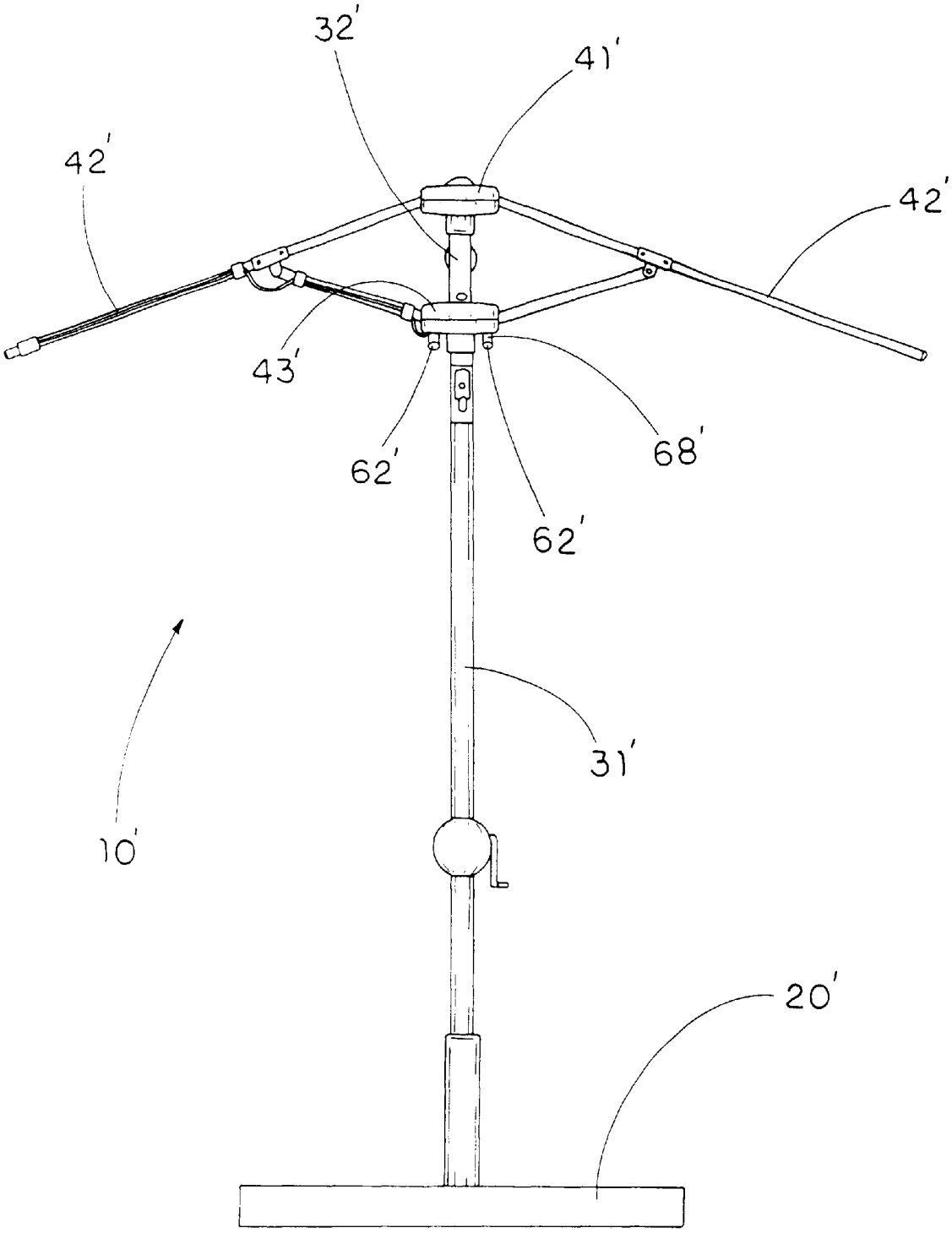
FIG. 12 is an elevation view of an alternative mode of the illuminating unit of the outdoor umbrella according to the above preferred embodiment of the present invention, illustrating how the alternative illuminating unit extended along the awning supporting arm.

Referring to FIGS. 12 to 13 of the drawings, a first alternative mode of illuminating arrangement 61' is illustrated, wherein the stem connecting arm 32' is upwardly and integrally extended from the main supporting stem 31'. Furthermore, the illuminating arrangement 61' comprises a ring-shaped lamp housing 68' having a storage cavity 681' provided therein, wherein the storage cavity 681' has a C-shaped cross section and the illuminating unit 62', which is embodied as a ring shaped fluorescent lamp, is arranged to be securely mounted and received inside the storage cavity 681'.

Figure 14:
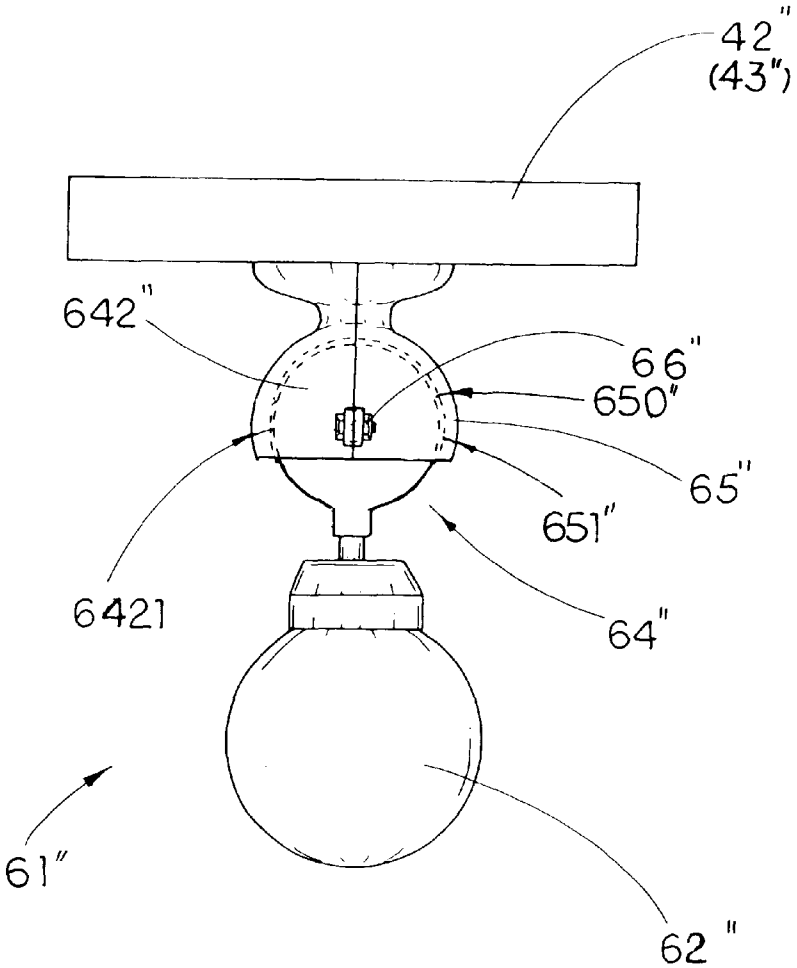
FIG. 14 is an elevation view of an alterative mode of illuminating unit supporter and adapter of the illuminating arrangement according to the above preferred embodiment of the present invention.

Referring to FIG. 14 of the drawings, an illuminating arrangement 61" according to a second alternative mode of the present invention is illustrated, wherein the engagement portion 641" of the illuminating unit adaptor 64' is in spherical shape, while the illuminating unit supporter 65" has a C-shaped interior receiving cavity 650" formed therein that forms a semi-spherical guiding surface 651". The illuminating unit supporter 65" pivotally holds and suspends the illuminating unit adaptor 64" so as to attach the illuminating unit 62" with the respective awning supporting arm 42", wherein a portion of the engagement member 642" of the illuminating unit adaptor 64" is received inside the interior receiving cavity 650" while the exterior spherical surface, that is the engaging surface 6421", of the engagement member 642" of the illuminating unit adaptor 64" is in contact with the guiding surface 651".

The illuminating unit supporter 65" is pre-divided into a pair of left half portion and right half portion. On the other hand, the connector 66" is a bolt and nut fastener that, one can place the engagement member 642" between the left and right half portions which are combined together by means of the connector 66". After joining the left and the right half portions together, the illuminating unit adaptor 64" received in the illuminating unit supporter 65" is detachably connected to the awning supporting arms 42" and/or the lower housing 43". Then, the illuminating adaptor 64" and the illuminating unit 62" mounted thereon are capable of freely rotating three-dimensionally as governed by the illuminating unit supporter 65", and capable of self-retaining in a substantially vertical orientation.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. An outdoor umbrella, comprising:

an umbrella awning;

an umbrella supporting frame which comprises a main supporting stem;

a foldable awning frame which is supported by said main supporting stem and comprises a plurality of awning supporting arms outwardly extended from said umbrella supporting frame to support said umbrella awning in a foldable manner to define a shading zone thereunder;

an attachable lighting system comprising at least an illuminating arrangement which comprises:

at least an illuminating unit for illumination;

at least an illuminating unit supporter securely connected to said awning frame; and at least an illuminating unit adaptor having an engagement member attached to said illuminating unit, wherein said illuminating unit adaptor is detachably attached to said illuminating unit supporter in such a manner that said illuminating unit connected to said illuminating unit adaptor is capable of maintaining a substantially vertical orientation when said awning frame is folding and unfolding or supported in an inclined position; and a power supply device electrically connected to said illuminating unit and supported by said awning frame for transmitting an electricity to said illuminating unit.

2. The outdoor umbrella, as recited in claim 1, wherein said illuminating unit supporter is detachably mounted to one of said awning supporting arms.

3. The outdoor umbrella, as recited in claim 1, wherein said illuminating unit supporter is mounted on a lower housing of said awning frame.

4. The outdoor umbrellas, as recited in claim 3, wherein said foldable awning frame further comprises an upper housing where said awning supporting arms are spacedly and radially extended therefrom, a plurality of lower connecting bars each having a lower end pivotally connected to said lower housing and an upper end pivotally connected to a mid-position of said respective awning supporting arms so as to support said awning supporting arms in a pivotally movable manner that said awning frame is capable of folding between a folded position by moving said lower housing apart from said upper housing and an unfolded position by moving said lower housing towards said upper housing, wherein said illuminating unit supporter is attached to said lower housing of said awning frame.

5. The outdoor umbrella, as recited in claim 2, wherein said illuminating unit supporter which has a guiding surface and said engagement member of said illuminating unit adaptor has an engaging surface arranged to slidably engage with said guiding surface of said illuminating unit supporter in such a manner that a weight of said illuminating unit maintains said illuminating unit to hang down from said illuminating unit supporter due to gravity, regardless of any inclined angle of said awning supporting arm.

6. The outdoor umbrella, as recited in claim 3, wherein said illuminating unit supporter which has a guiding surface and said engagement member of said illuminating unit adaptor has an engaging surface arranged to slidably engage with said guiding surface of said illuminating unit supporter in such a manner that a weight of said illuminating unit maintains said illuminating unit to hang down from said illuminating unit supporter due to gravity, regardless of any inclined angle of said awning frame.

7. The outdoor umbrella, as recited in claim 4, wherein said illuminating unit supporter which has a guiding surface and said engagement member of said illuminating unit adaptor has an engaging surface arranged to slidably engage with said guiding surface of said illuminating unit supporter in such a manner that a weight of said illuminating unit maintains said illuminating unit to hang down from said illuminating unit supporter due to gravity, regardless of any inclined angle of said awning frame.

8. The outdoor umbrella, as recited in claim 1, wherein said illuminating unit supporter comprises a supporting holder slidably mounted on a predetermined position of one of said awning supporting arms, wherein said supporting holder has a connecting member provided at a bottom bar thereof through which a threaded connecting hole is formed, and a mounting member positioned between a bottom side of said awning supporting arm and said bottom bar of said supporting holder, wherein a mounting slot is defined between said mounting member and said connecting member.

9. The outdoor umbrella, as recited in claim 2, wherein said illuminating unit supporter comprises a supporting holder slidably mounted on a predetermined position of one of said awning supporting arms, wherein said supporting holder has a connecting member provided at a bottom bar thereof through which a threaded connecting hole is formed, and a mounting member positioned between a bottom side of said awning supporting arm and said bottom bar of said supporting holder, wherein said guiding surface is formed at a bottom surface of said mounting member so as to define a mounting slot transversally extended between said guiding surface of said mounting member and said connecting member.

10. The outdoor umbrella, as recited in claim 2, wherein said illuminating unit supporter is a shank body transversely extended therethrough, which has an enlarged head mounted on an outer side of one of said awning supporting arms and a connecting member protruded from an inner side of said awning supporting arm, wherein a mounting slot transversely penetrates through said connecting member.

11. The outdoor umbrella, as recited in claim 2, wherein said illuminating unit supporter is a shank body transversely extended therethrough, which has an enlarged head mounted on an outer side of one of said awning supporting arms and a connecting member protruded from an inner side of said awning supporting arm, wherein a mounting slot transversely penetrates through said connecting member, wherein said guiding surface is formed at a top surface of said mounting slot.

12. The outdoor umbrella, as recited in claim 3, wherein said illuminating unit supporter comprises a coupling device which comprises a coupling base attached to said lower housing and a connecting member which has a mounting slot transversally provided at an upper portion and a threaded lower portion.

13. The outdoor umbrella, as recited in claim 8, wherein said engagement member of said illuminating unit adaptor has a circular shaped hook-like hanging arm attached to and upwardly extended from said illuminating unit, wherein said mounting slot has a size slightly larger than a cross section area of said engagement member and said illuminating unit adaptor is attached to said illuminating unit supporter by hooking said engagement member through said mounting slot.

14. The outdoor umbrella, as recited in claim 9, wherein said engagement member of said illuminating unit adaptor has a circular shaped hook-like hanging arm attached to and upwardly extended from said illuminating unit, wherein said mounting slot has a size slightly larger than a cross section area of said engagement member and said illuminating unit adaptor is attached to said illuminating unit supporter by hooking said engagement member through said mounting slot, wherein said guiding surface is an arucate surface and said engagement member has an arcuate engaging surface formed thereon, wherein said engaging surface is shaped and sized to have a surface curvature matched with said surface curvature of guiding surface of said illuminating unit supporter.

15. The outdoor umbrella, as recited in claim 10, wherein said engagement member of said illuminating unit adaptor has a circular shaped hook-like hanging arm attached to and upwardly extended from said illuminating unit, wherein said mounting slot has a size slightly larger than a cross section area of said engagement member and said illuminating unit adaptor is attached to said illuminating unit supporter by hooking said engagement member through said mounting slot.

16. The outdoor umbrella, as recited in claim 11, wherein said engagement member of said illuminating unit adaptor has a circular shaped hook-like hanging arm attached to and upwardly extended from said illuminating unit, wherein said mounting slot has a size slightly larger than a cross section area of said engagement member and said illuminating unit adaptor is attached to said illuminating unit supporter by hooking said engagement member through said mounting slot, wherein a top surface of said mounting slot forms said guiding surface which is an arucate surface and said engagement member has an arcuate engaging surface formed thereon, wherein said engaging surface is shaped and sized to have a surface curvature matched with said surface curvature of guiding surface of said illuminating unit supporter.

17. The outdoor umbrella, as recited in claim 12, wherein said engagement member of said illuminating unit adaptor has a circular shaped hook-like hanging arm attached to and upwardly extended from said illuminating unit, wherein said mounting slot has a size slightly larger than a cross section area of said engagement member and said illuminating unit adaptor is attached to said illuminating unit supporter by hooking said engagement member through said mounting slot.

18. The outdoor umbrella, as recited in claim 1, further comprising a locking means for locking said illuminating unit at a predetermined position with respect to said awning frame by securing said illuminating unit supporter with said illuminating unit adaptor.

19. The outdoor umbrella, as recited in claim 2, further comprising a locking means for locking said illuminating unit at a predetermined position with respect to said awning frame by securing said illuminating unit supporter with said illuminating unit adaptor.

20. The outdoor umbrella, as recited in claim 13, further comprising a locking means for locking said illuminating unit at a predetermined position with respect to said awning frame by pressing said engaging surface of said illuminating unit adaptor against said guiding surface of said illuminating unit supporter.

21. The outdoor umbrella, as recited in claim 14, further comprising a locking means for locking said illuminating unit at a predetermined position with respect to said awning frame by pressing said engaging surface of said illuminating unit adaptor against said guiding surface of said illuminating unit supporter, wherein said locking means which comprises a connector which is a bolt screwed into said threaded connecting hole until a top biasing end thereof is pressed against said lower surface of said engagement member so as to press said engaging surface of said engagement member against said guiding surface to provide a friction therebetween and thus fasten said engagement member in position, thereby by unfastening said connector until said top biasing end is not contact with said engagement member, said engagement member is free to pivotally slide along said mounting slot to adjust a hanging position of said illuminating unit.

22. The outdoor umbrella, as recited in claim 15, further comprising a locking means for locking said illuminating unit at a predetermined position with respect to said awning frame by pressing said engaging surface of said illuminating unit adaptor against said guiding surface of said illuminating unit supporter.

23. The outdoor umbrella, as recited in claim 16, further comprising a locking means for locking said illuminating unit at a predetermined position with respect to said awning frame by pressing said engaging surface of said illuminating unit adaptor against said guiding surface of said illuminating unit supporter, wherein said locking means comprises a connector which is a bolt screwed into an axial threaded connecting hole, which is penetrated from a bottom end of said illuminating unit supporter and upwardly extended to said mounting slot, until a top biasing end of said connector is pressed against said lower surface of said engagement member so as to press said engaging surface against said guiding surface and said supporting surface to provide a friction therebetween and thus fasten said engagement member in position, thereby by unfastening said connector until said top biasing end is not contact with said engagement member, said engagement member is free to pivotally slide along said mounting slot to adjust a hanging position of said illuminating unit.

24. The outdoor umbrella, as recited in claim 17, further comprising a locking means for locking said illuminating unit at a predetermined position with respect to said awning frame by pressing said engaging surface of said illuminating unit adaptor against said guiding surface of said illuminating unit supporter.

25. The outdoor umbrella, as recited in claim 17, wherein said mounting slot is an arcuate through hole and said upper portion of said connecting member upwardly penetrates through a connecting hole provided at a bottom wall of said coupling base until said mounting slot is positioned inside said coupling base, wherein said locking means comprises a connector which is adapted to screw to said threaded lower portion of said connecting member so as to hold said engagement member in position, moreover by screwing said connector against said coupling base substantially pulls said engagement member down against said coupling base via said connecting member so as to fasten said engagement member at a predetermined position.

26. The outdoor umbrella, as recited in claim 25, wherein an upper surface of said mounting slot forms a guiding surface adapted to direct said illuminating unit to move in a pivot manner, a surface curvature of said guiding surface is arranged to match with said shape and size of said engaging surface of said engagement member, wherein said guiding surface is in full contact with said engaging surface of said engagement member to maximize said supporting surface area for said engagement member with respect to said illuminating unit supporter.

27. The outdoor umbrella, as recited in claim 17, wherein said coupling device further comprises a clamping means for detachably mounting said coupling base to said lower housing.

28. The outdoor umbrella, as recited in claim 24, wherein said coupling device further comprises a clamping means for detachably mounting said coupling base to said lower housing.

29. The outdoor umbrella, as recited in claim 25, wherein said coupling device further comprises a clamping means for detachably mounting said coupling base to said lower housing.

30. The outdoor umbrella, as recited in claim 26, wherein said coupling device further comprises a clamping means for detachably mounting said coupling base to said lower housing.

31. The outdoor umbrella, as recited in claim 27, wherein said clamping means comprises a plurality of resilient clamping members each having a coupling portion coupled with said coupling base and one clamping portion upwardly extended therefrom to define a clamping cavity between said clamping portions of said clamping members to receive said lower housing therein and a fastening device for fastening said clamping portions of said clamping members to said lower housing.

32. The outdoor umbrella, as recited in claim 30, wherein said clamping means comprises a plurality of resilient clamping members each having a coupling portion coupled with said coupling base and one clamping portion upwardly extended therefrom to define a clamping cavity between said clamping portions of said clamping members to receive said lower housing therein and a fastening device for fastening said clamping portions of said clamping members to said lower housing.

33. The outdoor umbrella, as recited in claim 31, wherein said fastening device comprises a control button and a fastening strap, wherein said control button comprises a receiving body and a presser slidably inserted thereto, wherein said receiving body has a through hole formed and said fastening strap is arranged to slidably insert into said through hole of said receiving body, wherein said control button further comprises a resilient element which is received in said receiving body and arranged to normally apply an urging force to said fastening strap in such a manner that when said presser is depressed, said fastening strap is capable of freely sliding, and when said depressing force is relieved, said presser is rebounded to its original position and said fastening strap is pressed by said resilient element, wherein said coupling device is mounted to said lower housing when a bottom portion of said lower housing in inserted in to said clamping cavity of said coupling device and said fastening strap is tightened around said clamping members by operating said control button.

34. The outdoor umbrella, as recited in claim 32, wherein said fastening device comprises a control button and a fastening strap, wherein said control button comprises a receiving body and a presser slidably inserted thereto, wherein said receiving body has a through hole formed and said fastening strap is arranged to slidably insert into said through hole of said receiving body, wherein said control button further comprises a resilient element which is received in said receiving body and arranged to normally apply an urging force to said fastening strap in such a manner that when said presser is depressed, said fastening strap is capable of freely sliding, and when said depressing force is relieved, said presser is rebounded to its original position and said fastening strap is pressed by said resilient element, wherein said coupling device is mounted to said lower housing when a bottom portion of said lower housing in inserted in to said clamping cavity of said coupling device and said fastening strap is tightened around said clamping members by operating said control button.

35. The outdoor umbrella, as recited in claim 3, wherein said illuminating arrangement comprises a ring-shaped lamp housing having a storage cavity provided therein, wherein the storage cavity has a C-shaped cross section and said illuminating unit is arranged to be securely mounted and received inside the storage cavity.

36. The outdoor umbrella, as recited in claim 5, wherein said engagement member of said illuminating unit adaptor is in spherical shape, while said illuminating unit supporter has a C-shaped interior receiving cavity formed therein that forms said guiding surface in semi-spherical shape, wherein said illuminating unit supporter pivotally holds and suspends said illuminating unit adaptor so as to attach said illuminating unit to said illuminating unit supporter, wherein a portion of said engagement member of said illuminating unit adaptor is received inside said interior receiving cavity while said engaging surface is in contact with said guiding surface.

37. The outdoor umbrella, as recited in claim 36, further comprising a locking means for locking said illuminating unit at a predetermined position with respect to said awning frame by securing said illuminating unit supporter with said illuminating unit adaptor by increasing a friction therebetween.

38. The outdoor umbrella, as recited in claim 37, wherein said illuminating unit supporter is pre-divided into a pair of left half portion and right half portion and said locking means comprises a connector to secure said left and right half portions together, wherein by joining said left and right half portions together, said illuminating unit adaptor received in said illuminating unit supporter is detachably connected to said respective awning supporting arm.

39. The outdoor umbrella, as recited in claim 6, wherein said engagement member of said illuminating unit adaptor is in spherical shape, while said illuminating unit supporter has a C-shaped interior receiving cavity formed therein that forms said guiding surface in semi-spherical shape, wherein said illuminating unit supporter pivotally holds and suspends said illuminating unit adaptor so as to attach said illuminating unit to said illuminating unit supporter, wherein a portion of said engagement member of said illuminating unit adaptor is received inside said interior receiving cavity while said engaging surface is in contact with said guiding surface.

40. The outdoor umbrella, as recited in claim 39, further comprising a locking means for locking said illuminating unit at a predetermined position with respect to said awning frame by securing said illuminating unit supporter with said illuminating unit adaptor by increasing a friction therebetween.

41. The outdoor umbrella, as recited in claim 40, wherein said illuminating unit supporter is pre-divided into a pair of left half portion and right half portion and said locking means comprises a connector to secure said left and right half portions together, wherein by joining said left and right half portions together, said illuminating unit adaptor received in said illuminating unit supporter is detachably connected to said respective awning supporting arm.

42. The outdoor umbrella, as recited in claim 1, wherein said power supply device comprises at least one connecting plug extended from one of said illuminating units, at least a connecting socket which is securely mounted on said awning frame and arranged to be plugged by said connecting plug, and a power inlet which is connected to said connecting socket via at least an electrical cord for electrically connecting with an external power source so as to transmit electricity to said illuminating unit.

43. The outdoor umbrella, as recited in claim 42, wherein said power supply device further comprises a cord holder for securely mounting said electrical cord to said awning frame.

44. The outdoor umbrella, as recited in claim 43, wherein said cord holder comprises a ring-shaped holding body defining a cord-receiving cavity for receiving said electrical cord therethrough and a frame-holding cavity, which is communicated with said cord-receiving cavity, for receiving one of said awning supporting arms therethrough.

45. The outdoor umbrella, as recited in claim 44, wherein said cord holder further comprises a securing member adapted to engage with said holding body for tightening up said cord holder and securely mounting said cord holder to said respective awning supporting arm.

46. The outdoor umbrella, as recited in claim 45, wherein said securing member has two securing slots at two ends respectively, wherein a plurality of ratchet teeth are formed on two inner side of two parallel holding arms of said holding body for engaging through said two securing slots of said securing member respectively so as to tightening up said cord holder, wherein said electrical cord can be securely mounted onto said awning supporting arm by penetrating said electrical cord through said cord-receiving cavity, then putting said awning supporting arm into said frame-holding cavity, and finally engaging said securing member with said plurality of ratchet teeth on said holding body.

47. The outdoor umbrella, as recited in claim 42, wherein said power supply device further comprises a cord holder and a socket holder for securely mounting said electrical cord and said connecting socket to said awning frame.

48. The outdoor umbrella, as recited in claim 47, wherein said socket holder comprises a socket holder body defining a socket-receiving cavity for receiving said connecting socket and a frame-receiving cavity for receiving said awning supporting arm.

49. The outdoor umbrella, as recited in claim 48, wherein said socket holder further comprises a tightening member adapted to engage with said socket holder body for tightening up said socket holder.

50. The outdoor umbrella, as recited in claim 49, wherein said tightening member has two tightening slots at two ends thereof respectively, wherein a plurality of ratchet teeth are formed at two inner sides of two parallel holder arms for engaging through said two tightening slots of said tightening member respectively so as to tightening up said socket holder, wherein said connecting socket is able to be securely mounted onto said awning supporting arm by securing said connecting socket in said socket-receiving cavity, then penetrating said awning supporting arm through said frame-receiving cavity, and finally engaging said tightening member with socket holder body.

51. The outdoor umbrella, as recited in claim 5, wherein said power supply device comprises at least one connecting plug extended from one of said illuminating units, at least a connecting socket which is securely mounted on said awning frame and arranged to be plugged by said connecting plug, and a power inlet which is connected to said connecting socket via at least an electrical cord for electrically connecting with an external power source so as to transmit electricity to said illuminating unit.

52. The outdoor umbrella, as recited in claim 51, wherein said power supply device further comprises a cord holder for securely mounting said electrical cord to said awning frame.

53. The outdoor umbrella, as recited in claim 52, wherein said cord holder comprises a ring-shaped holding body defining a cord-receiving cavity for receiving said electrical cord therethrough and a frame-holding cavity, which is communicated with said cord-receiving cavity, for receiving one of said awning supporting arms therethrough, wherein said cord holder further comprises a securing member adapted to engage with said holding body for tightening up said cord holder and securely mounting said cord holder to said respective awning supporting arm, wherein said securing member has two securing slots at two ends respectively, wherein a plurality of ratchet teeth are formed on two inner side of two parallel holding arms of said holding body for engaging through said two securing slots of said securing member respectively so as to tightening up said cord holder, wherein said electrical cord can be securely mounted onto said awning supporting arm by penetrating said electrical cord through said cord-receiving cavity, then putting said awning supporting arm into said frame-holding cavity, and finally engaging said securing member with said plurality of ratchet teeth on said holding body.

54. The outdoor umbrella, as recited in claim 51, wherein said power supply device further comprises a cord holder and a socket holder for securely mounting said electrical cord and said connecting socket to said awning frame.

55. The outdoor umbrella, as recited in claim 54, wherein said socket holder comprises a socket holder body defining a socket-receiving cavity for receiving said connecting socket and a frame-receiving cavity for receiving said awning supporting arm, wherein said socket holder further comprises a tightening member adapted to engage with said socket holder body for tightening up said socket holder, wherein said tightening member has two tightening slots at two ends thereof respectively, wherein a plurality of ratchet teeth are formed at two inner sides of two parallel holder arms for engaging through said two tightening slots of said tightening member respectively so as to tightening up said socket holder, wherein said connecting socket is able to be securely mounted onto said awning supporting arm by securing said connecting socket in said socket-receiving cavity, then penetrating said awning supporting arm through said frame-receiving cavity, and finally engaging said tightening member with socket holder body.

56. The outdoor umbrella, as recited in claim 6, wherein said power supply device comprises at least one connecting plug extended from one of said illuminating units, at least a connecting socket which is securely mounted on said awning frame and arranged to be plugged by said connecting plug, and a power inlet which is connected to said connecting socket via at least an electrical cord for electrically connecting with an external power source so as to transmit electricity to said illuminating unit.

57. The outdoor umbrella, as recited in claim 56, wherein said power supply device further comprises a cord holder for securely mounting said electrical cord to said awning frame.

58. The outdoor umbrella, as recited in claim 57, wherein said cord holder comprises a ring-shaped holding body defining a cord-receiving cavity for receiving said electrical cord therethrough and a frame-holding cavity, which is communicated with said cord-receiving cavity, for receiving one of said awning supporting arms therethrough, wherein said cord holder further comprises a securing member adapted to engage with said holding body for tightening up said cord holder and securely mounting said cord holder to said respective awning supporting arm, wherein said securing member has two securing slots at two ends respectively, wherein a plurality of ratchet teeth are formed on two inner side of two parallel holding arms of said holding body for engaging through said two securing slots of said securing member respectively so as to tightening up said cord holder, wherein said electrical cord can be securely mounted onto said awning supporting arm by penetrating said electrical cord through said cord-receiving cavity, then putting said awning supporting arm into said frame-holding cavity, and finally engaging said securing member with said plurality of ratchet teeth on said holding body.

59. The outdoor umbrella, as recited in claim 56, wherein said power supply device further comprises a cord holder and a socket holder for securely mounting said electrical cord and said connecting socket to said awning frame.

60. The outdoor umbrella, as recited in claim 59, wherein said socket holder comprises a socket holder body defining a socket-receiving cavity for receiving said connecting socket and a frame-receiving cavity for receiving said awning supporting arm, wherein said socket holder further comprises a tightening member adapted to engage with said socket holder body for tightening up said socket holder, wherein said tightening member has two tightening slots at two ends thereof respectively, wherein a plurality of ratchet teeth are formed at two inner sides of two parallel holder arms for engaging through said two tightening slots of said tightening member respectively so as to tightening up said socket holder, wherein said connecting socket is able to be securely mounted onto said awning supporting arm by securing said connecting socket in said socket-receiving cavity, then penetrating said awning supporting arm through said frame-receiving cavity, and finally engaging said tightening member with socket holder body.

* * * * *